US010660494B1

(12) United States Patent
Alton

(10) Patent No.: US 10,660,494 B1
(45) Date of Patent: May 26, 2020

(54) VACUUM CLEANER

(71) Applicant: James R. Alton, Bellingham, WA (US)

(72) Inventor: James R. Alton, Bellingham, WA (US)

( * ) Notice: Subject to any disclaimer, the term of this patent is extended or adjusted under 35 U.S.C. 154(b) by 1803 days.

(21) Appl. No.: 13/694,154

(22) Filed: Oct. 31, 2012

Related U.S. Application Data

(60) Provisional application No. 61/628,489, filed on Oct. 31, 2011.

(51) Int. Cl.
*A47L 9/02* (2006.01)
*A47L 5/28* (2006.01)

(52) U.S. Cl.
CPC ..... *A47L 9/02* (2013.01)

(58) Field of Classification Search
None
See application file for complete search history.

(56) References Cited

U.S. PATENT DOCUMENTS

| | | | | |
|---|---|---|---|---|
| 1,139,736 | A | 5/1915 | Stabel | |
| 1,161,908 | A | 11/1915 | Tice | |
| 2,203,088 | A | 6/1940 | Hansson | |
| 2,242,163 | A | 5/1941 | Bargeboer | |
| 2,297,933 | A | 10/1942 | Yonkers, Jr. | |
| 2,974,347 | A | 3/1961 | Seyfried | |
| 3,159,412 | A | 12/1964 | Descarries | |
| 3,220,043 | A | 11/1965 | Lampe | |
| 3,633,942 | A | 1/1972 | Meyerhoefer | |
| 4,309,048 | A | 1/1982 | Ahlf et al. | |
| 4,700,429 | A | 10/1987 | Martin et al. | |
| 4,709,443 | A * | 12/1987 | Bigley | 15/339 |
| 5,185,903 | A | 2/1993 | Choi | |
| 5,584,095 | A | 12/1996 | Redding et al. | |
| 6,055,703 | A | 5/2000 | Redding et al. | |
| 6,581,974 | B1 | 6/2003 | Ragner et al. | |
| 6,991,262 | B1 | 1/2006 | Ragner | |
| 7,174,593 | B2 | 2/2007 | Soejima et al. | |
| 7,257,852 | B2 | 8/2007 | Shibuya et al. | |
| 7,503,098 | B2 | 3/2009 | Stein | |
| 7,507,269 | B2 * | 3/2009 | Murphy | A47L 9/165 55/337 |
| 7,591,043 | B2 | 9/2009 | Ninomiya et al. | |
| 7,900,317 | B2 | 3/2011 | Stephens et al. | |
| 8,060,981 | B2 | 11/2011 | Bassett et al. | |
| 8,082,624 | B2 | 12/2011 | Myers | |
| 8,181,309 | B2 | 5/2012 | Mersmann et al. | |
| 2001/0037536 | A1 | 11/2001 | Kim | |

(Continued)

*Primary Examiner* — Brian D Keller

(57) ABSTRACT

A vacuum cleaner having a body supported on frame members that join to form a saddle beneath the body and are connected to a central member that extends downwardly to a nozzle assembly. The central member is tubular and communicates with a passage in one of the upper frame members to form a flow path from the nozzle assembly. An articulated neck interconnects the central member and the nozzle assembly to transmit front-to-back and rotational motions applied via a handle above the body. A detachable hose forms a flow path from the tubular frame members to a bag housing in an upper part of the body. A motor housing below the bag housing includes a diverter that directs air and noise from the vacuum blower against a closed rearward wall and out a front vent directed away from the user. An ozone generator introduces ozone/ions into the discharge air.

20 Claims, 37 Drawing Sheets

(56) References Cited

U.S. PATENT DOCUMENTS

| | | | | |
|---|---|---|---|---|
| 2003/0051309 | A1* | 3/2003 | Morgan | A47L 5/30 15/373 |
| 2003/0145422 | A1* | 8/2003 | Kaffenberger et al. | 15/377 |
| 2004/0184975 | A1* | 9/2004 | Anno | 422/186.04 |
| 2008/0148512 | A1* | 6/2008 | Beskow et al. | 15/350 |
| 2009/0056059 | A1* | 3/2009 | Mersmann et al. | 15/347 |

* cited by examiner

FIG. 6A
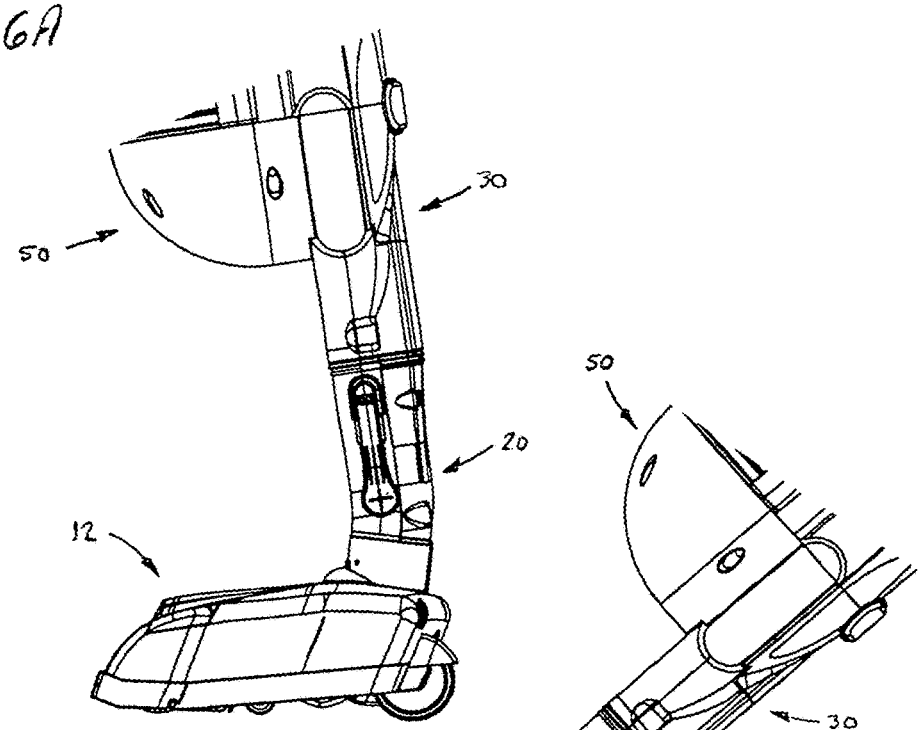
FIG. 6B
FIG. 6C
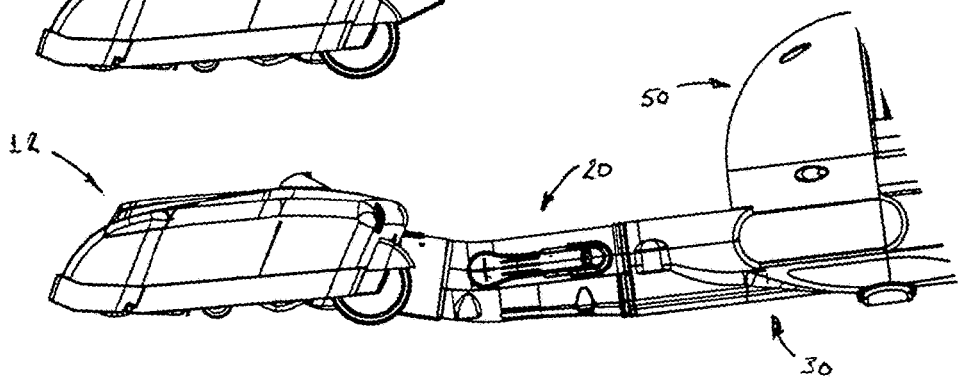

FIG. 20A
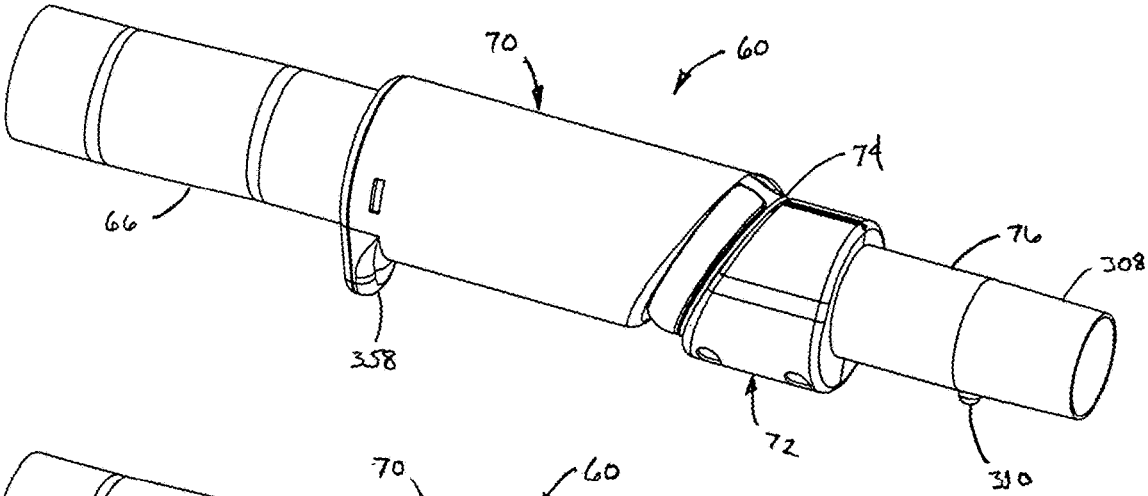
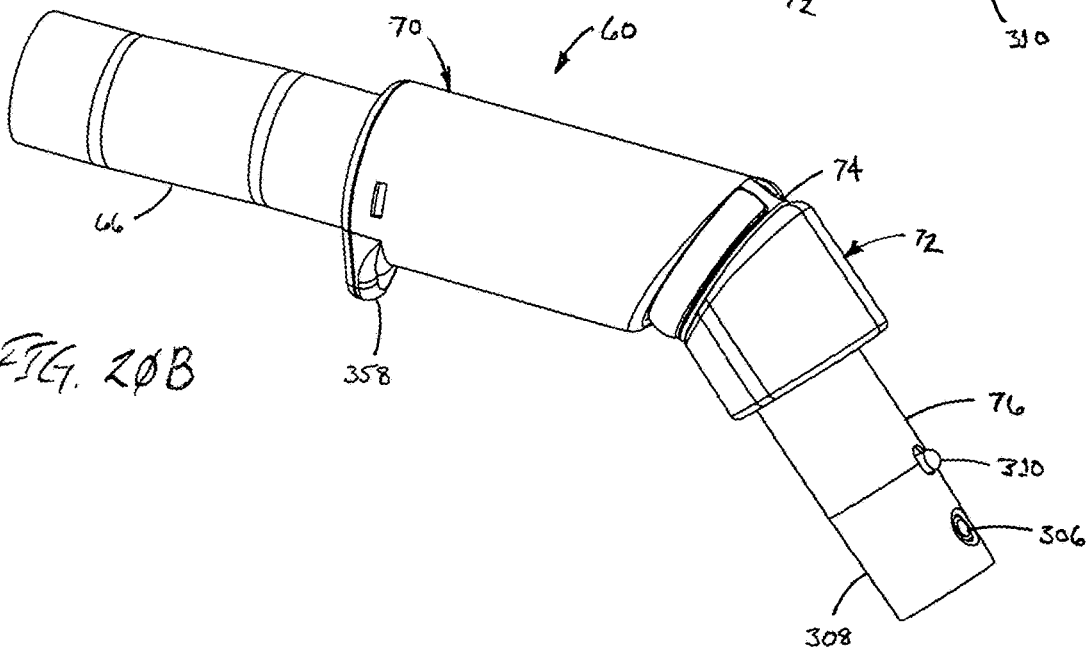
FIG. 20B 370
372
376
382
374
371
66
68
62
364
379
378
366
358
356
360
362
348
346
342
352
354
340
344
70
72
320
326
334
336
350
338
332
323
325
322
324
355
314
312
316
310
306
308
74

515
513
517
518
519
520
521
522
523
524
525
526
528
529
530
531
532
533
534
536

FIG 42A
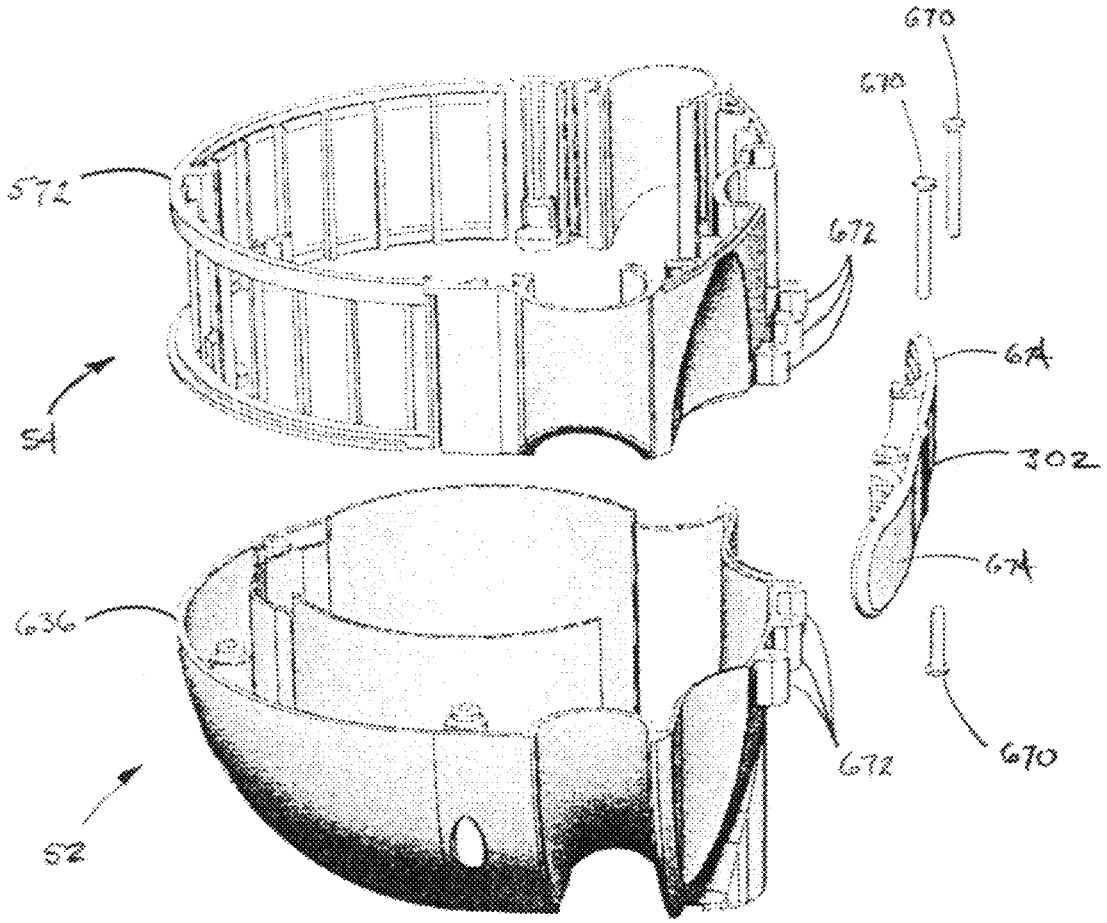
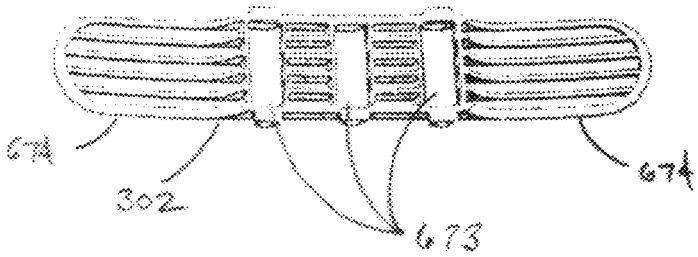
FIG 42B

VACUUM CLEANER

RELATED APPLICATIONS

This application claims the benefit of U.S. Provisional Patent Application Ser. No. 61/628,489 filed on Oct. 31, 2011.

BACKGROUND a. Field of the Invention

The present invention relates generally to portable cleaning apparatus, and, more particularly, to a vacuum cleaner having enhanced maneuverability, durability, efficiency and other improved characteristics.

b. Related Art

Portable vacuum cleaners, e.g., for home or commercial use, fall mainly into the categories of upright-type and canister-type machines. Although both upright and canister vacuum cleaners have relative strengths, upright machines are generally more popular due to advantages in terms of compactness, lower cost, convenience and overall performance on carpet.

Improvements that build on the inherent advantages of upright vacuum cleaners can lead to a significantly enhanced product, particularly if they can be implemented while at the same time maintaining the advantage of low cost. For example, reduced weight can significantly enhance convenience, both during use and when moving the vacuum cleaner to and from storage. Similarly, improved maneuverability can also significantly enhance convenience, for example, making it easier to work around and under furniture and other stationary objects in a room. At the same time, it is important that improvements in weight and maneuverability not be achieved at the cost of a loss in durability and service life.

Another area of advancement is the use of vacuum tools and accessories, such as crevice tools, upholstery nozzles, and so on. In the past such tools and accessories were more or less the exclusive purview of canister-type vacuums, however, more recent upright machines may include a hose to which tools/accessories can be connected. and improvements that render it easier to attach and use such tools/accessories can again significantly enhance versatility of the vacuum cleaner.

Another factor of increasing importance is air quality, particularly the quality of the air that is discharged from the vacuum cleaner during operation. For example, while developments in collection bag technology have resulted in decreased discharge of particulates, further decreases remain desirable. Reduced noise of operation represents yet another potential enhancement.

Accordingly, there exists a need for an upright-type vacuum cleaner having a low weight combined with a high degree of maneuverability. Furthermore, there exists a need for such a vacuum cleaner having superior structural integrity and durability for long service life. Still further, there exists a need for such an upright-type vacuum cleaner that provides improved convenience for the use of hose-attached vacuum tools and accessories. Still further, there exists a need for such a vacuum cleaner that generates lower levels of noise during operation. Still further, there exists a need for such a vacuum cleaner in which the qualities of the discharge airflow are enhanced. Still further, there exists a need for such a vacuum cleaner that can be manufactured on an economical basis.

SUMMARY OF THE INVENTION

The present invention addresses the problems cited above, and provides a vacuum cleaner with enhanced performance and operating characteristics.

In a first aspect, the present invention provides a vacuum cleaner comprising (a) a nozzle assembly; (b) an upright body assembly; and (c) a frame assembly that supports the body assembly on the nozzle assembly, the frame assembly comprising (i) first and second elongate frame members having spaced apart, upper end portions that extend along first and second lateral sides of the body assembly and lower end portions that converge at a junction generally beneath the body assembly, and (ii) a central member that extends generally downwardly to support the body assembly on the nozzle assembly.

The downwardly extending central member may be continuous with the first upwardly extending frame member. The downwardly extending central frame member may comprise a bore that is continuous with a bore of said upwardly extending member so as to establish a path for a flow of air from the nozzle assembly to the body assembly. The downwardly extending member and first upwardly extending member may comprise a continuous tubular member. The second upwardly extending member may comprise a second tubular member. The second tubular members may be joined by a clamp assembly at the juncture beneath the body assembly.

The upper end portions of the first and second frame members may be substantially equidistantly spaced on opposite sides of a front-to-back centerline plane of the vacuum cleaner lying in a straight-ahead direction of motion of the nozzle assembly, and the downwardly extending frame member may be substantially centered on the front-to-back centerline plane. The upwardly extending ends of the first and second members may be mounted to opposite sides of the body assembly so as to balance loads transferred thereby from the body assembly to the downwardly extending frame member. The junction between the first and second upwardly extending members may form a saddle that supports at least a portion of the weight of the body assembly.

The body assembly may comprise at least one handle member that enables an operator to apply front-to-back and rotational motions to the body assembly. The handle member may be substantially centered on the front-to-back centerline plane of the body assembly.

The vacuum cleaner may further comprise an articulated neck assembly that interconnects the downwardly-extending centerline frame member and the nozzle assembly so as to transmit to the nozzle assembly the motions applied by the user to the body assembly. The neck assembly may comprise an internal passage continuous with the passage of the downwardly-extending centerline frame member and first upwardly extending frame member that forms the flow path from the nozzle assembly to the body assembly.

The articulated elbow assembly may comprise upper and lower segments joined at a pivot connection. The upper segment may comprise a tubular sleeve portion that receives a lower end of the downwardly-extending centerline member of the frame assembly that is mounted to the body assembly. The upper segment of the elbow assembly may further comprise a latch mechanism that releasably retains the lower end of the downwardly-extending centerline frame member in the tubular sleeve portion. The latch mechanism may comprise a latch lever having a tooth end that is yieldingly biased through an opening in the sleeve portion into engagement with a cooperating opening in the lower end of the downwardly-extending tubular frame member.

The lower segment of the elbow assembly may comprise a generally barrel-shaped body having an opening on a distal side thereof that communicates with an internal chamber of the nozzle assembly to establish a flow path therewith, and a generally cylindrical surface that forms a sliding seal against cooperating surfaces of the nozzle assembly on sides of the opening in the nozzle assembly. The body of the lower segment may further comprise first and second axle portions extending axially from opposite ends, that cooperate with axle fittings in the nozzle assembly to establish a horizontal axis pivot connection between the nozzle assembly and the lower segment of the elbow assembly.

The pivot connection between the upper and lower segments of the elbow assembly may comprise a tubular neck portion on an end of the lower segment opposite the barrel-shaped body, and a tubular opening on an end of the upper segment opposite the sleeve portion, that receives the tubular neck of the lower segment in rotating engagement therewith. The pivot connection may further comprise a band member mounted around the end of the upper segment over the tubular opening having the neck portion of the lower segment received therein, that stabilizes the pivot joint against loads transmitted from the body and frame assemblies to the nozzle assembly via the elbow assembly. The band member may be a band formed of metal, such as stainless steel. The band may have a width sufficient to extend over substantially the full length of the end opening of the upper segment in which the neck portion of the lower segment is received.

The pivot connection may further comprise an insert member that retains the neck portion of the lower segment of the elbow assembly in rotating engagement with the lower end portion of the upper segment. The insert member may comprise a shoulder that engages an annular ring about the neck portion of the lower segment, so as to prevent the neck portion of the lower segment from being withdrawn while allowing the lower member to rotate relative to the upper member, and means for mounting the insert member to the end of the upper segment of the assembly. The means for mounting the insert member to the upper segment of the elbow assembly may comprise a cap member having at least one leg that extends through an opening in the band member to be received in locking engagement with a cooperating recess on the insert member.

The vacuum cleaner may further comprise an upper frame assembly mounted to the body assembly and having an upper end to which the at least one handle member is mounted. The upper frame assembly may comprise an elongate bar member that is mounted to a rearward side of the body assembly. The body assembly may comprise a channel in which the elongate bar is mounted, with the bar extending upwardly above an upper end of the body assembly.

The vacuum cleaner may further comprise a hose assembly having a passage for the flow of air from the nozzle assembly to the body assembly. The hose assembly may comprise a flexible hose and a handle assembly mounted on an end of the hose. The vacuum cleaner may further comprise means for detachably connecting the handle assembly to an end of the first tubular member of the lower frame assembly for passage of the flow of air from the lower frame assembly to the flexible hose.

The handle assembly may comprise a base member that is mounted to the end of the hose, a distal member that has an intake opening, a pivot connection that joins the base and distal members. The distal member may comprise means for interchangeably mounting a plurality of vacuum tools to the intake opening thereof.

The base member of the handle assembly may comprise a handle portion for being gripped by an operator. The pivot connection that joins the base and distal members of the handle assembly may comprise an angled-axis pivot connection that permits selective adjustment of an angle of the distal member of the handle assembly relative to the base member. The angled-axis pivot connection may comprise a first tubular portion on the base member that extends at an angle to the handle portion thereof, a second tubular portion on the distal member that extends at an angle to the intake end thereof that is substantially equal to the angle at which the first tubular portion extends to the handle portion, and a coupling member that joins the first and second tubular portions at the pivot joint of the handle assembly, so that the angle of the distal member of the handle assembly is adjustable within a range from a first angle in which the intake end of the distal member is aligned substantially parallel with the handle portion of the base member to a second angle in which the intake end of the distal member extends at the angle of the first and second tubular portions to the handle portion of the base member.

The tubular connection portion of the distal member may comprise an angled tubular neck, and the tubular connection portion of the base member may comprise an angled tubular sleeve that receives the tubular neck of the distal member for rotation therein. The coupling member may comprise a ring member that is mounted about the angled sleeve portion of the base member and that comprises a plurality of tooth portions that extend through cooperating openings in the angled sleeve portion to engage cooperating annular grooves in the angled tubular neck of the distal member so as to retain the neck in the angled sleeve of the base member while permitting rotation of the distal member relative to the base member. The ring member may comprise a split ring that is selectively expandable to be installed over the angled end sleeve of the base member.

The intake end of the distal member may comprise a stinger tube sized to be interchangeably received in cooperating tubular sleeve portions of a plurality of vacuum tools. The angled tubular neck of the distal member of the handle assembly may comprise an angled neck of a grip portion of the distal member. The grip portion may be mounted over an end of the distally extending stinger tube. The grip portion may comprise first and second clamp halves that are mounted around a base end of the stinger tube.

The handle assembly may further comprise a hose connection that permits the base member to rotate relative to the flexible vacuum hose to which the base member is attached. The hose connection may comprise an annular insert member mounted on an end of the flexible vacuum hose, a cylindrical receiver opening formed in an end of the base member that receives the annular insert member in rotating engagement therewith, and a retainer member that engages the base member rearwardly of the annular insert member so as to retain the insert member in the receiver opening. The retainer member may comprise a sleeve portion through which the flexible vacuum hose passes in rotating relationship therewith and that is received in the receiver opening of the handle member in non-rotating engagement therewith. The retainer member may comprise at least one tooth member that engages a notch in the receiver opening in locking engagement therewith. The retainer member may further comprise a laterally extending flange portion that is received in a cooperating recess on a rearward side of a finger rest portion of the handle portion of the base member so as to hold the retainer member against rotation relative to the base member. The insert member may further comprise an annular seal member that forms a rotating seal with the receiver opening of the base member.

The connector member mounted on the end of the flexible vacuum hose may comprise an internally threaded bore that engages a spiral winding of the vacuum hose so as to permit the connector member to be installed by being threaded thereon. The connector member may further comprise a distal edge having reversed-angled teeth that engage the flexible material of the hose so as to prevent the connector member unthreading from the end of the hose.

The body assembly of the vacuum cleaner may comprise a vacuum blower that generates the flow of air that is received by the body assembly from the nozzle assembly of the vacuum cleaner and an ozone generator that introduces a supply of ozone and ions into the flow of air. The body assembly of the vacuum cleaner may comprise a bag housing that contains a filter bag that collects particulate material from the flow of air, and the ozone generator may comprise an ozone generator located to introduce the ozone and ions into the flow of air after the filter bag. The body may further comprise means for supplying exterior air to the ozone generator. The means for supplying exterior air to the ozone generator may comprise a passage having an orifice sized to introduce exterior air to the ozone generator at a metered rate. The ozone generator may comprise a housing having an inlet passage through which exterior air enters, via the orifice, a UV lamp mounted within the housing, and a titanium dioxide-laden outlet grill that is exposed to the UV lamp and through which air exits the housing carrying the ozone produced by the generator.

The body assembly of the vacuum cleaner may further comprise a pre-filter through which the flow of air passes after exiting the filter bag and prior to entering the vacuum blower. The pre-filter may comprise a filter element mounted in a lower end of the bag housing above an intake of the vacuum blower. The body assembly may further comprise a doughnut seal mounted around a discharge side of the filter element and an intake opening of the vacuum blower to establish a sealed flow path between the pre-filter and the blower.

The vacuum blower may comprise a radial discharge blower driven by a motor. The housing may comprise a mount portion having the motor of the vacuum blower mounted thereto. The motor housing may further comprise a substantially closed rearward wall, and an interior diverter wall that extends around a front and sides of the radial-discharge blower so that a flow of air discharged by the blower is contained by the diverter wall and is directed against the closed rearward wall of the housing, together with noise emitted from the vacuum blower. The motor housing may further comprise an outer wall that is spaced from the diverter wall so as to form an annular flow cavity into which the flow of air is diverted by the closed rearward wall of the housing. The outer wall may comprise a layer of sound absorbing material to further reduce noise emitted from the vacuum blower.

The body assembly may further comprise an exhaust vent through which the flow of air from the vacuum blower is exhausted from the vacuum cleaner. The exhaust vent may be positioned at a front of the body so that air and noise exiting through the vent is directed away from a user at the rear of the vacuum cleaner. The vent may comprise a filter element that provides a final degree of filtering before the flow of air is discharged into the surroundings. The exhaust vent may be mounted generally above the motor housing so that the flow of air moves upwardly and forwardly thereto from the annular flow cavity.

The body assembly of the vacuum cleaner may further comprise a lid housing mounted atop the bag housing. The lid housing may comprise a lid member that is selectively openable to provide access to a filter bag in the bag housing. The bag housing may comprise a plurality of inwardly directed ribs that support the medium of the filter bag while leaving channels intermediate the ribs for the flow of air exiting the bag. The ozone generator may be mounted in the bag housing in communication with at least one of the channels so as to introduce the ozone into the flow of air exiting the filter bag.

These and other features and advantages of the present invention will be more fully appreciated from a reading of the following detailed description with reference to the accompanying drawings.

BRIEF DESCRIPTION OF THE DRAWINGS

FIGS. 6A-6C are sequential, partial side elevational views of the nozzle and lower portions of the upright vacuum cleaner of FIGS. 1-2, showing the manner in which the articulated elbow assembly of FIGS. 4-5 enables the vacuum cleaner to be pivoted to a reclined position that enables the nozzle assembly to reach under chairs, tables and other articles of furniture;

FIGS. 20A-20B are sequential front perspective views of the handle assembly of FIGS. 18-19, showing the assembly with the attachment end rotated between straight and maximum-angled positions;

FIG. 42A is an exploded, perspective view of the shells of the exhaust and motor housings of the body assembly of FIGS. 22-23, showing the manner in which the rearward sides of the housings are clamped together by the lower cord bracket of the assembly; and FIG. 42B is a front perspective view of the lower cord bracket of FIG. 42A.

DETAILED DESCRIPTION a. Overview

Figure 1:
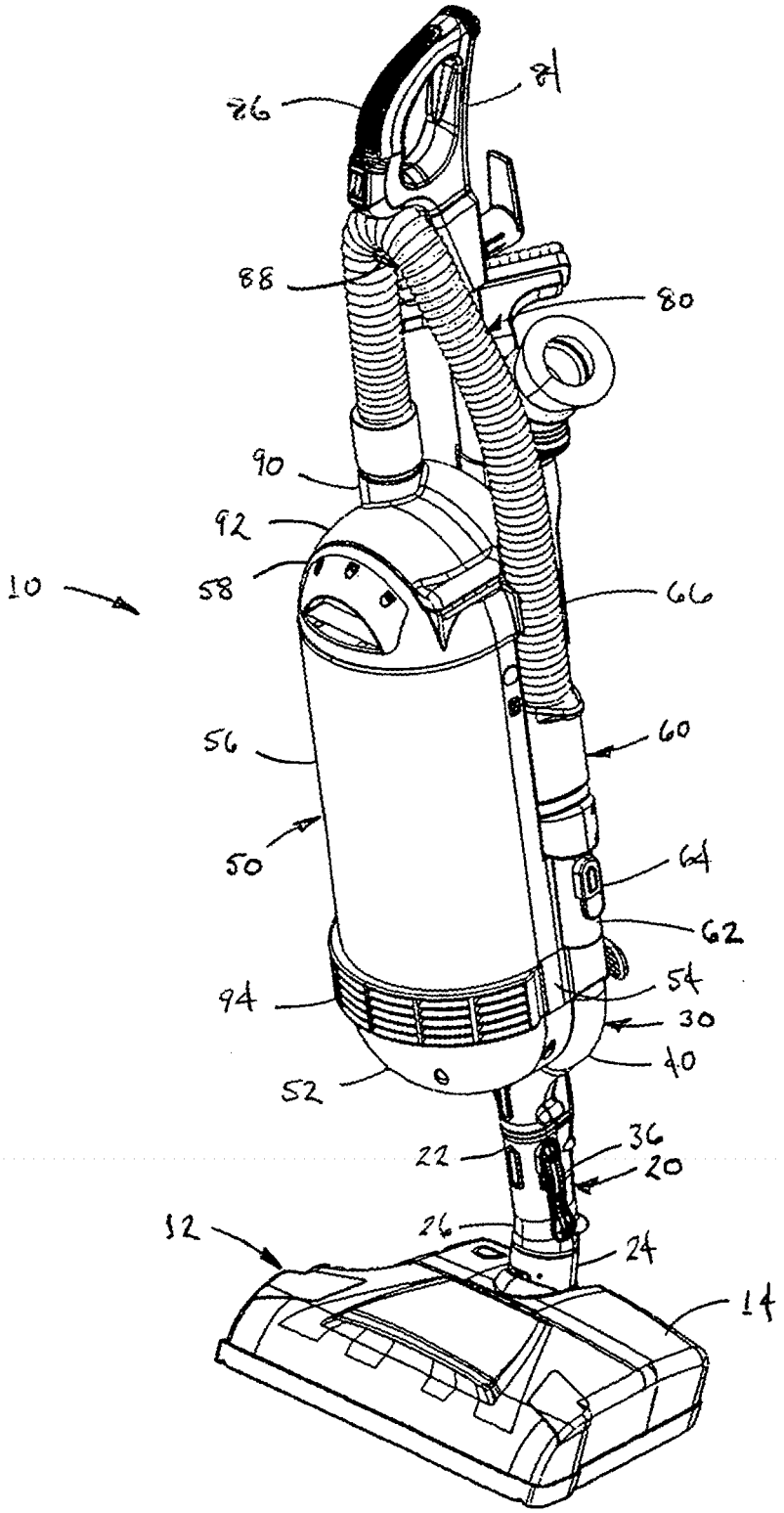
FIG. 1 is a front perspective view of an upright vacuum cleaner in accordance with the present invention.
Figure 2:
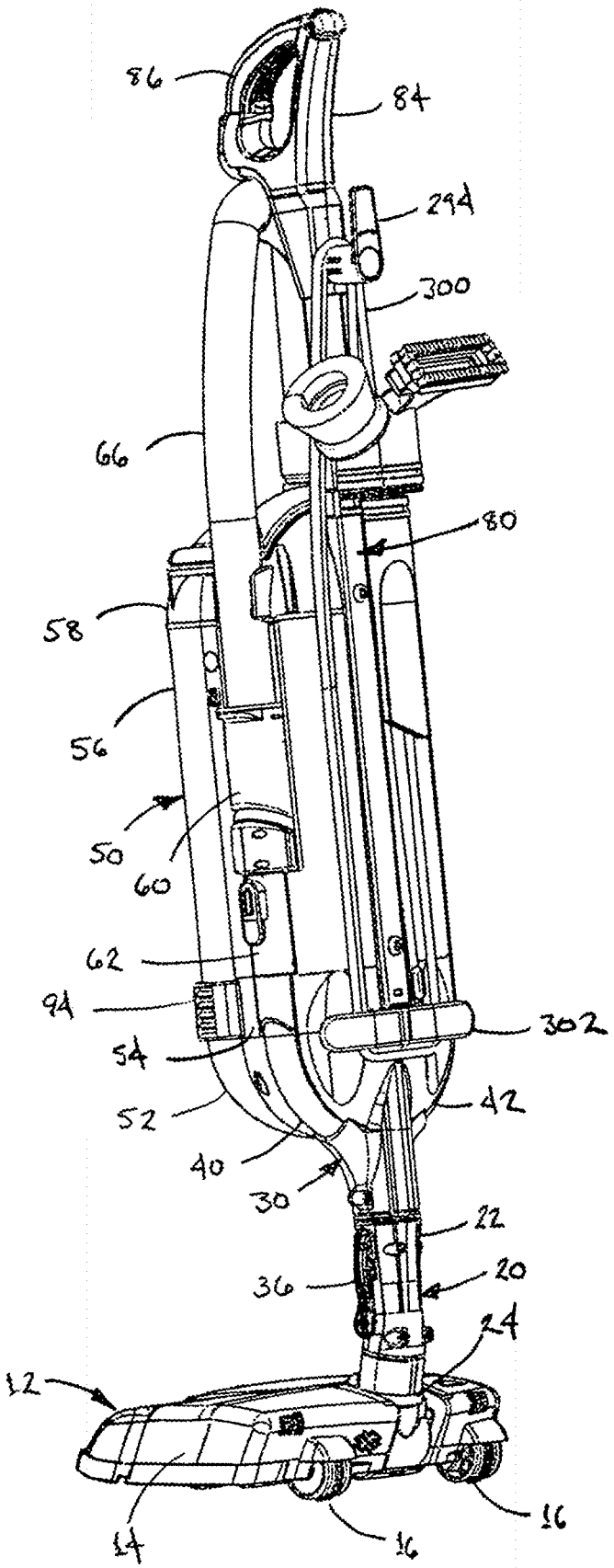
FIG. 2 is a rear perspective view of the upright vacuum cleaner of FIG. 1.

FIGS. 1-2 show an upright vacuum cleaner 10 in accordance with a preferred embodiment of the present invention.

Figure 3:
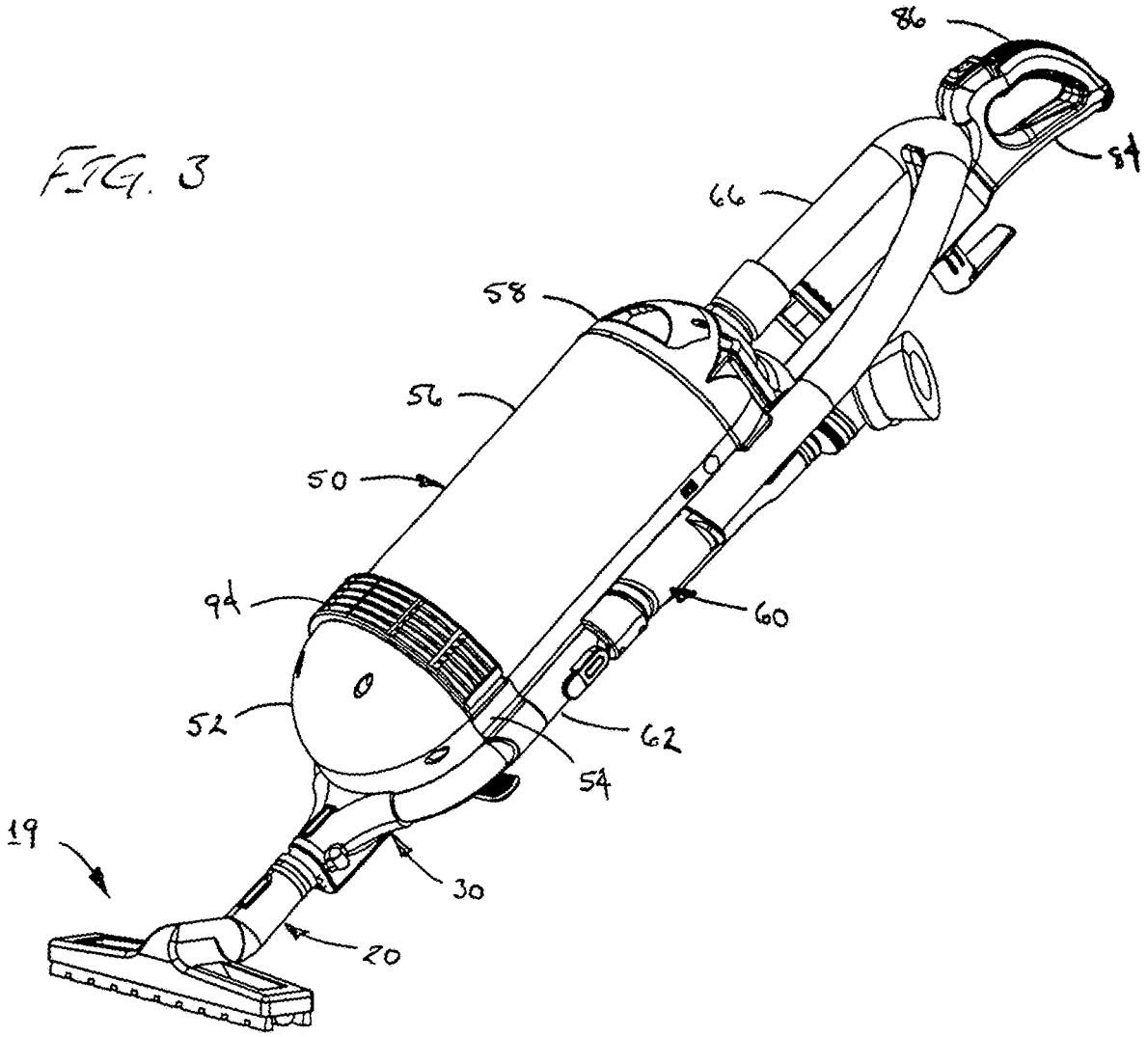
FIG. 3 is a front perspective view of an upright vacuum cleaner in accordance with another embodiment of the present invention, having an non-powered floor nozzle rather than the power nozzle of the embodiment of FIGS. 1-2.

As can be seen, vacuum cleaner 10 includes a nozzle assembly 12 that applies suction to the floor surface being cleaned. In the preferred embodiment that is illustrated, the nozzle assembly 12 is a power nozzle assembly having a motor (not shown) in a housing 14 supported on wheels 16 that operates a roller brush 18; however, it will be understood that some embodiments may employ non-powered nozzle assemblies, such as the non-powered floor nozzle 19 that is illustrated in FIG. 3.

The nozzle assembly 12 is mounted at the rear to an articulated elbow assembly 20. As will be described in greater detail below, the elbow assembly includes upper and lower sections 22, 24 that are connected so as to pivot about a generally upwardly extending axis at a joint 26, the lower section 24 in turn being connected to the nozzle assembly 12 so as to form a horizontal axis pivot joint. A passage formed by hollow interiors continues through both sections to create a flow path for air and suspended particulate matter received from the nozzle assembly.

Figure 4:
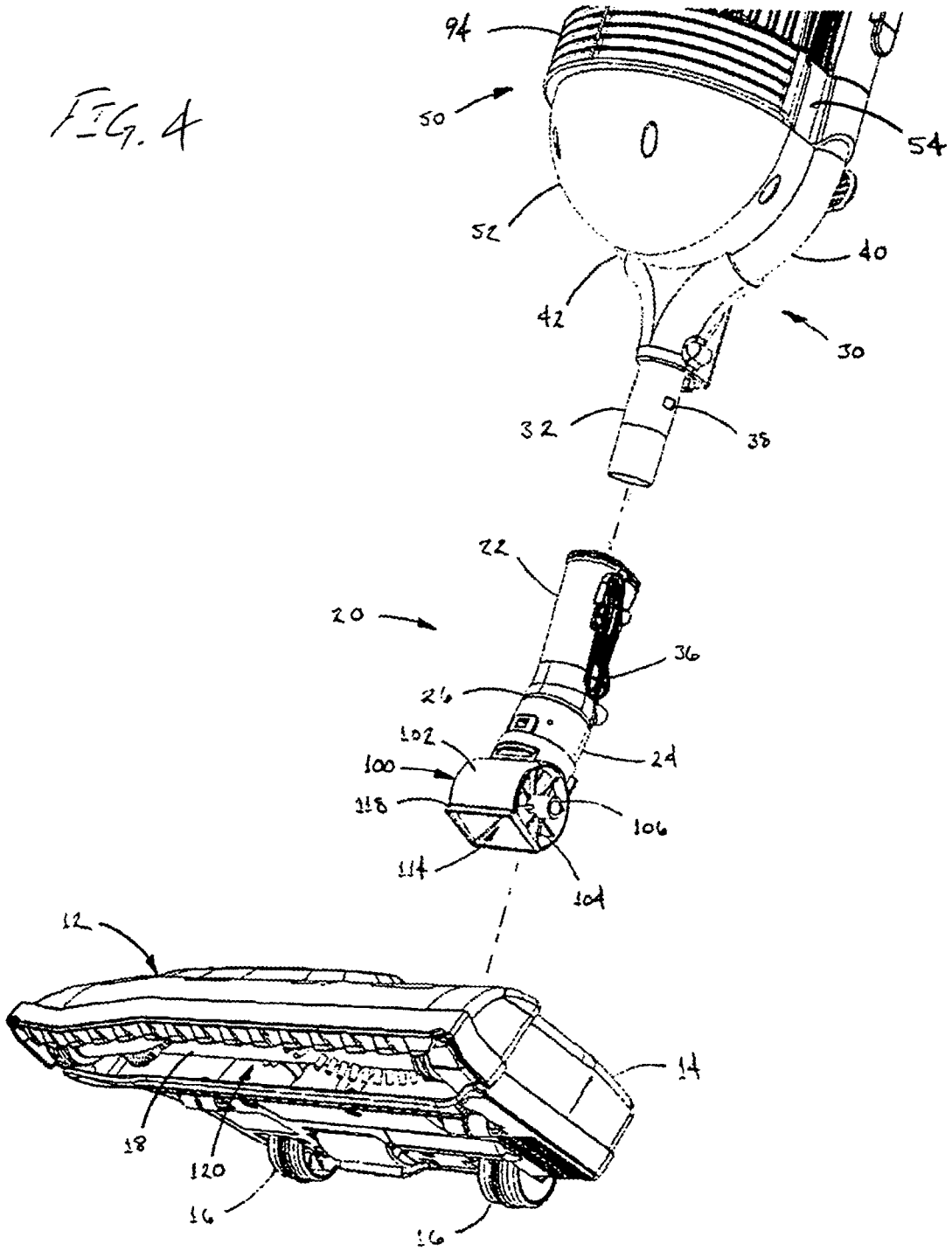
FIG. 4 is a lower front partial perspective view of the articulated elbow assembly and power nozzle assembly of the vacuum cleaner of FIGS. 1-2, showing the neck assembly separated from the power nozzle and from the frame and body assembly of the vacuum cleaner.

A tubular, generally Y-shaped lower frame assembly 30 is attached to the upper section 22 of the articulated elbow assembly 20, a central downwardly extending member 32 (see FIG. 3) being received in a sleeve formed by the tubular passage 34 of the elbow assembly and secured thereto by a latch mechanism 36 (see FIG. 4) that engages a cooperating opening 38 in the tubular member 32. As will be described in greater detail below, the two upper "legs" of the Y-shaped frame assembly are formed by generally mirror image upper ends of tubular members 40, 42, the first being continuous with extension 32 and forming a part of the air passage from the nozzle assembly.

The junction of the Y-shaped frame structure forms a saddle area that supports and engages the lower part of the body 50 of the machine. As can be seen, the divergent upper tubular members 40, 42 are received in a cooperating channel formed in the bottom of motor housing 52 and are clamped to the exhaust housing 54 at the sides of the body assembly, the upper bag housing 50 and lid housing 58 being mounted atop the latter. As will be described in greater detail below, the Y-shaped configuration of the lower frame assembly effectively transmits loads between the body and other upper parts of the vacuum cleaner and the nozzle assembly, via the elbow assembly 20, in a balanced manner that enhances both maneuverability and durability of the machine.

As can be seen with further reference to FIGS. 1-2, a hose handle assembly 60 is detachably mounted to the upper end of the first tubular member 40 of the Y-shaped lower frame, in a holder 62 having a latch mechanism 64. The upper end of the handle assembly is in turn mounted to the end of a flexible hose 66 to which vacuum is applied by the blower motor in housing 52, as will be described below, the flexible hose suitably having a conventional wound construction with spiral ridges and grooves 67, 68.

The hose handle assembly 60 includes base (upper) and distal (lower) sections 70, 72, joined at a pivot connection 74 so as to rotate at an angle to one another. A tubular tail piece 76 having an intake opening extends from the distal section 72, and is received in the bore 78 of the tubular holder 62 when in the stowed position. By actuating latch mechanism 64, hose handle assembly 60 can be selectively removed from holder 62 and a vacuum tool or accessory (e.g., a crevice tool, an upholstery brush, and so on) attached to tail piece 76 so that the vacuum is applied thereto via hose 66; then, with the tool/accessory removed, the handle assembly can be returned to its stowed position, with tail piece 76 inserted in holder 62 so that vacuum is applied therethrough to the nozzle assembly for normal operation.

An upper frame assembly 80 of the machine includes an elongate, generally linear bar member 82 mounted to the rear of body assembly 50 substantially in line with elbow assembly 20, so that the bar member, the upper section 22 of the elbow assembly, and the depending tail section 32 of the lower frame assembly all lie generally within a centerline, front-to-rear plane. A handle 84 is mounted to the upper end of the generally vertically extending bar member 82, and includes a forwardly projecting loop 86 that forms a hand grip, also lying generally in the front-to-back centerline plane of the machine. This relationship enables an operator to achieve a high degree of maneuverability using the machine, by conveniently rotating the wrist and hand in one direction or another while extending/retracting the arm, as will be described in greater detail below.

Lid housing 58 represents the intake side of the body assembly 50 of the machine, the vacuum hose 66 being routed to a connection 90 on the lid assembly over a hook 88 at the front of handle 84 when in the normal operating position. As will be described in greater detail below, the lid housing includes a hinged lid section 92 that opens to provide access for removal/replacement of a particulate collection bag contained within bag housing 56.

Suction is applied to the bottom of the bag housing by the vacuum blower in motor housing 52, producing an airflow drawing particulate matter into the collection bag from hose 66, from nozzle assembly 12 or alternatively from a cleaning tool/accessory attached to handle assembly 60 when removed from holder 62. The particulate matter is captured in the bag, and the air drawn therethrough passes through a blower prefilter and then through the blower and then through additional exhaust filters before being discharged through vent 94 at the front of exhaust housing 54.

Having provided an overview of the preferred embodiment of FIGS. 1-2, certain of the assemblies thereof will be described in greater detail below.

b. Articulated Elbow Assembly

As noted above, and as can be seen in FIGS. 4-5, the articulated elbow assembly 20 includes upper and lower sections 22, 24 connected at joint 26 so as to be pivotable relative to one another about a generally upwardly-extending axis that lies substantially within the centerline front-to-back plane of the machine. The upper section forms a tubular sleeve into which the downwardly extending tail piece 32 of the Y-shaped frame assembly is inserted, the tail piece being retained therein by engagement of the latch mechanism 36 with opening 38.

Figure 5:
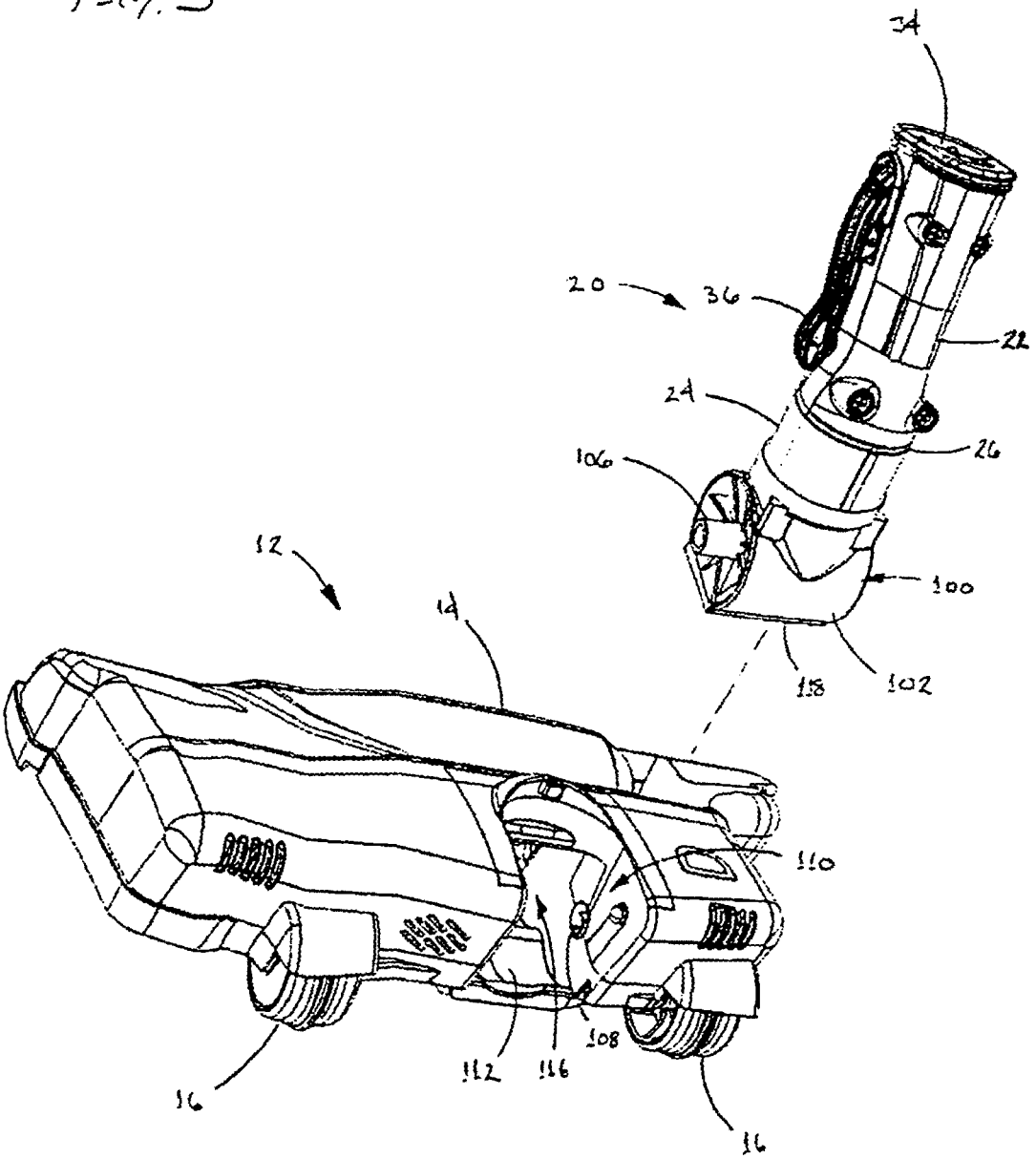
FIG. 5 is an upper rear perspective view of the elbow assembly and power nozzle assembly of FIG. 4, showing the manner in which the assemblies are joined to form a pivot connection.

The lower elbow section 24, in turn, includes a barrel-shaped end portion 100 having a generally cylindrical outer surface 102 and end wall structures 104 that support first and second axles 106 (one only being visible in FIGS. 4-5) that extend outwardly along the horizontal axis of the cylindrical wall 102. As can be seen in FIG. 5, the projecting axles 106 (which may optionally be provided with metal bushings or other bearings) on barrel 100 are received in cooperating sockets 108 formed in the sides of an opening 110 at the rear of nozzle housing 14, to form a horizontal pivot connection between the elbow assembly 20 and nozzle assembly 12 that extends somewhat perpendicular to the axis of rotation between the lower and upper sections 24, 22 of the assembly. Cylindrically concave surfaces 112 on the nozzle housing cooperate with the cylindrically convex surfaces 102 of the barrel-shaped end portion 100 to help support and guide the elbow assembly when pivoting relative to the nozzle assembly, and also help to establish a seal for the flow path between the nozzle and elbow. An intake opening 114 on the distal side of the barrel portion of lower elbow section 26 establishes fluid communication between the elbow assembly and a plenum 116 in the nozzle assembly forward of opening 110, opening 114 being bordered by a projecting lip 118 that fits into the throat of the plenum and reacts against upper and lower edges thereof to act as a stop limiting the range of pivoting motion between the nozzle and elbow assemblies.

Plenum 116 is in fluid communication with the intake opening 120 at the bottom of the nozzle assembly, in which a roller brush 18 is located in the power nozzle assembly of the illustrated embodiment. Vacuum that is generated by the blower in the main body of the machine is thus applied to the intake opening 120 of the nozzle assembly via elbow assembly 20 and plenum 116, drawing in air and particulate matter that travel to the collection bag through the flow path described above.

The two-axis pivot connection formed by articulated elbow 20 between the nozzle assembly and the frame assembly and thereby with the upper parts of the machine renders the machine conveniently maneuverable by an operator. For example, as will be described in greater detail below, by simply rotating the wrist of the hand that is holding grip 86, the operator is able to turn the nozzle assembly left and right with a high degree of precision, in a natural manner and with minimal effort. The horizontal pivot connection formed by the axles on the elbow and the sockets on the power nozzle, in combination with the arc of motion permitted between the barrel of the elbow assembly and the concave surfaces of the nozzle assembly, enable the frame and upper body assemblies 30, 50 of the vacuum cleaner to be pivoted between a generally upright configuration for storage (as shown in FIG. 6A), through a roughly 45° angle for normal operation (as seen in FIG. 6B), to a fully reclined orientation in which the body and handle extend almost parallel to the floor (as shown in FIG. 6C) so that the nozzle assembly is able to reach floor surfaces below furniture and other low-clearance obstructions. Moreover, the construction of the elbow assembly endows it with a high degree of rigidity and structural integrity.

Figure 7:
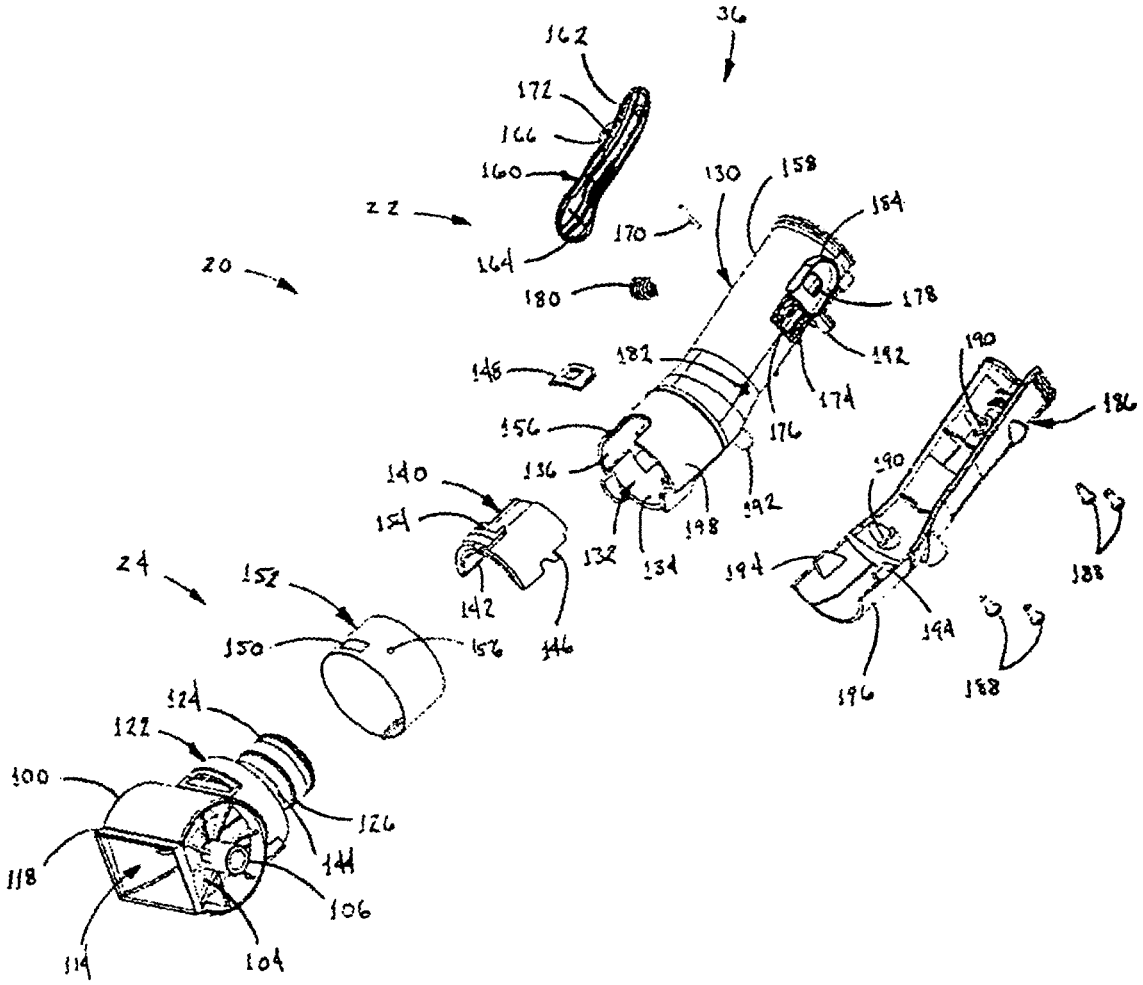
FIG. 7 is an exploded view of the elbow assembly of FIGS. 4-5, showing the components thereof in greater detail.

As can be seen in the exploded view of FIG. 7, the main member of the lower section 24 of the elbow assembly is a tubular body 122 having horizontal axis barrel portion 100 and intake opening 114 on its distal end. A cylindrical neck portion 124 extends on the opposite side of body 122, and includes an annular ridge or collar 126 set back a spaced distance from the end of the neck. The upper section 22, in turn, includes a tubular body 130 having a lower end opening 132 that forms a receiver for the neck 124 of the lower section. The distal part of the receiver opening includes a generally hemi-cylindrical bearing surface 134, while the upper portion is cut back to a surface 136 having an increased diameter that is sized to receive a cooperating, somewhat hemi-cylindrically shaped retainer member 140, the latter including a concavely curved, generally hemi-cylindrical bearing surface 142 that is sized to correspond to the first bearing surface 134. When the retainer member is inserted in opening 132, into cutaway area 136, the two hemi-cylindrical surfaces 134, 142 are positioned to define a substantially continuous bearing surface sized diametrically and located to form a cooperating interface with cylindrical bearing surface 144 that permits the lower and upper sections to rotate about the upwardly-extending axis as describe above.

A semi-annular ridge or shoulder 146 on the retainer member in turn reacts against collar 126 on tubular neck 124 to retain the latter. The retainer member is itself secured in end opening 132 by a locking cap 148 having depending leg portions (not shown in FIG. 5) that are inserted through an opening 150 in a circumferential band 152 to engage recess and cooperating locking lugs 154 on the insert; the raised locking lugs 154 cooperate with a longitudinally extending notch 156 to establish alignment of the insert within opening 132, while the band 152 is fixedly mounted to the end of the tubular member 130 by a rivet (not shown) or other fastener inserted through opening 156, with the result that the band and cap 148 form a stable, locked connection between the retainer member 140 and tubular member 130.

The rotational axis that is formed at the lower end of body 130 extends at an angle to the axis of the tubular upper sleeve portion 158 that is selected to provide enhanced handling characteristics, e.g., at an angle of about 10-15°. Latch mechanism 36 is mounted at the side of the upper sleeve portion 158, and includes a lever 160 having a protruding lug 162 at one end and a thumb pad 164 at the other, with a hinge portion 166 at a fulcrum point between the two. Pivot pin 170 that passes through cooperating bores 172, 174 in the hinge portion of the latch lever and a cooperating hinge portion 176 on the side of sleeve 158 form a pivot connection between the lever and body 130, with the locking lug 162 aligned to protrude through an opening 178 to engage a co-aligned opening 38 in the tail piece of frame assembly 30. A coil compression spring 180 is mounted under the thumb pad at the opposite end of the latch lever, around a protruding "+" shaped alignment lug, with alignment of the lever in turn being maintained by raised, U-shaped wall 184 that partially surrounds the opposite end of the lever.

Accordingly, to release the elbow assembly from the lower frame assembly 30, the user applies pressure to the thumb rest portion 164 of lever 160, compressing spring 180 so as to pivot the lever around axial pin 170 and withdraw lug 162 from engagement with the opening 38 in tail piece 32; then, when released, the pressure exerted by spring 180 pivots the lever in the opposite direction and biases locking lug 162 through opening 178 back into engagement with opening 38 in the tail piece of the frame.

As can be seen with further reference to FIG. 7, the elbow assembly of the illustrated embodiment additionally includes a back cover 186 that mounts to the rearward side of the tubular upper body 130, by means of screws 188 that pass through cooperating openings 190 in the back cover and are threaded into cooperating bosses 192 on body 130. The back cover has a channel-shaped configuration that roughly follows a generally convexly curved rearward side of body 130, but at a spaced distance therefrom, and provides a protective shell for wiring that is routed from the upper part of the machine to the motor and other components in nozzle assembly 12. A pair of protruding tabs 194 proximate the lower end of the back cover aid in maintaining a stable alignment between it and body 130. At the lower ends of the body 130 and back cover 186 are cylindrically curved outer surfaces 196, 198 that align to form a substantially continuous cylindrical outer surface when the parts are assembled, over which the metal band 152 is installed to provide a strong, durable joint structure between the upper and lower bodies 130, 122 of the elbow assembly.

The components of the elbow assembly are suitably formed of high-strength moulded plastic, such as polycarbonate for example, with the exception of pieces such as the coil spring, pivot pin and locking band, which are preferably formed of steel or other metallic material.

c. Frame Assembly

As noted above, the frame includes lower and upper assemblies 20, 80 that are interconnected by the main body 50 of the machine, and that transmit loads from the handle to the nozzle assembly that supports the vacuum cleaner on the floor.

Figure 8:
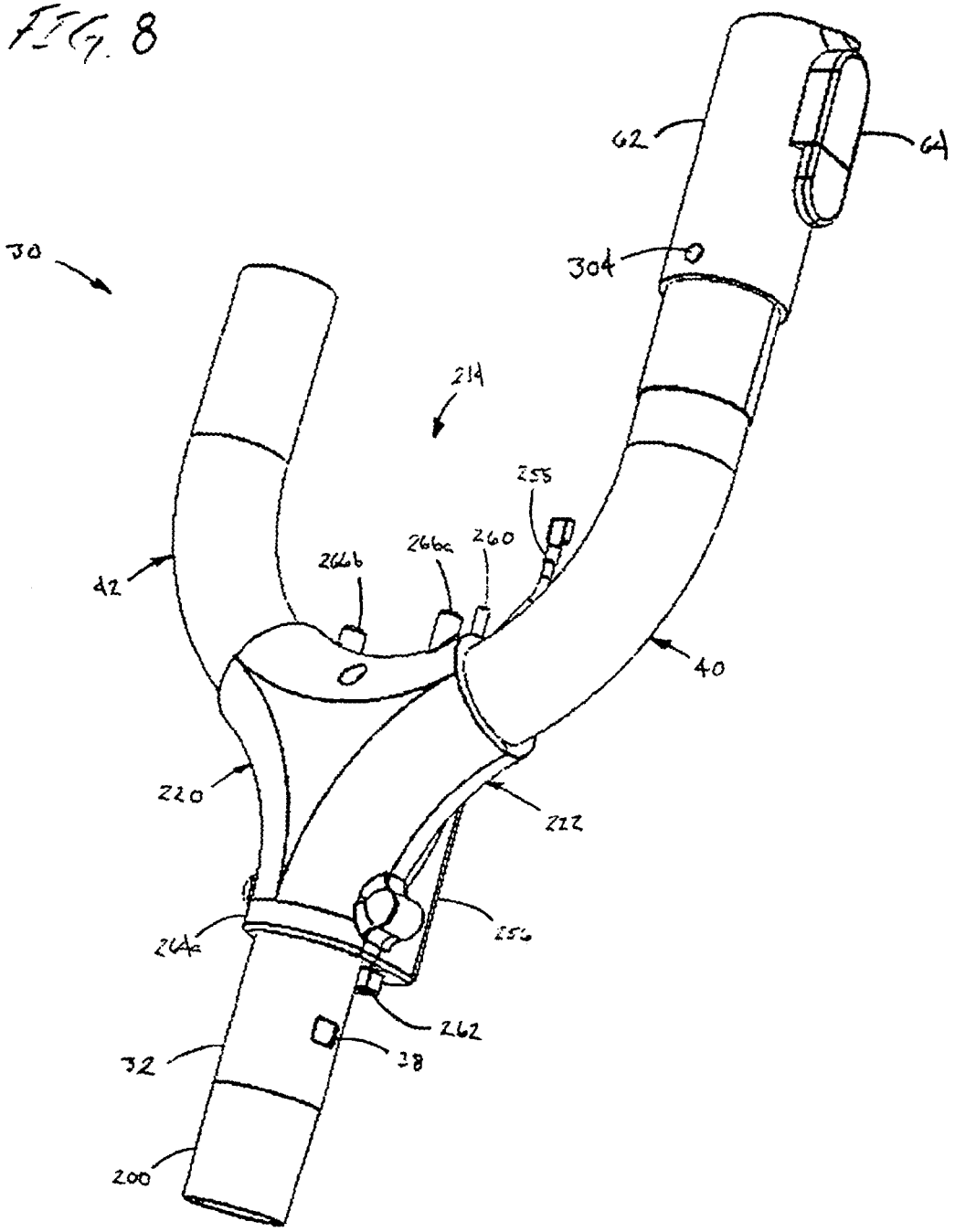
FIG. 8 is a lower perspective view of the Y-shaped lower frame section of the frame and body assembly of FIGS. 1-2.
Figure 9:
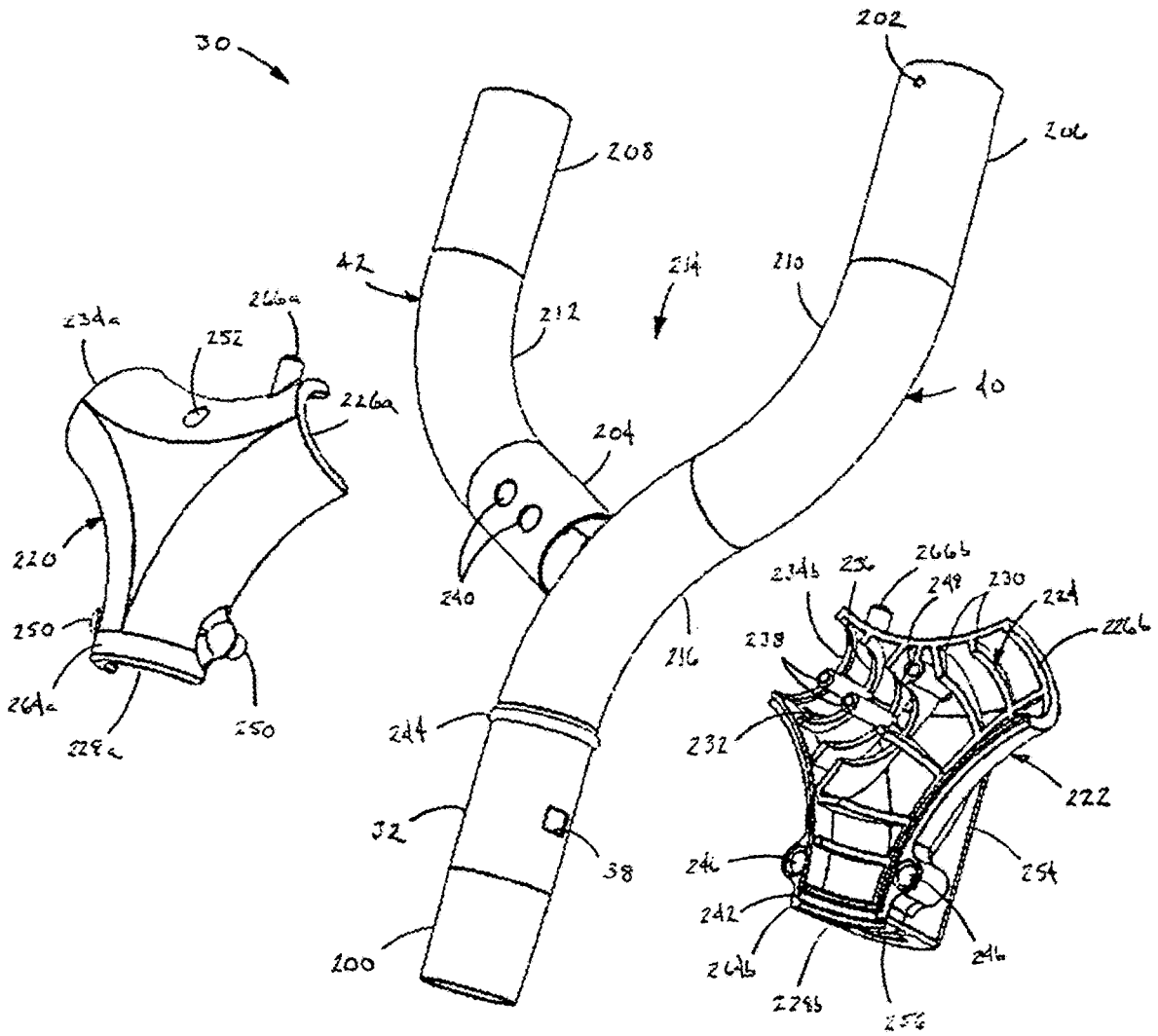
FIG. 9 is an exploded view of the Y-shaped frame section of FIG. 8, showing the tubular construction thereof in greater detail.

As previously noted and as can be seen in greater detail in FIGS. 8-9, the lower frame assembly 30 is a generally Y-shaped structure having first and second spaced apart, generally parallel tube members 40, 42 that come together at a central juncture, from which the tail piece 32 extends downwardly to its connection with the elbow assembly. As can be seen most clearly in FIG. 9, the first tubular member 40 is continuous with tail piece 32 so as to define an uptake flow path from the elbow assembly 20 to the hose assembly 60, the lower end of tail piece 32 having a distal taper 200 for insertion into the sleeve portion elbow assembly and the upper end of frame member 40 having a mounting hole 202 for connection to the handle holder 62, as will be described in greater detail below. The second tubular member 42 is a "blind" member in the sense that it does not (at least in the embodiment that is illustrated) form a flow path, but instead terminates at a lower end 204 adjacent a closed side of the first tubular member 40.

As can be seen with further reference to FIG. 9, the upper end portions 206, 208 of the tubular frame members 40, 42 lie generally parallel to one another, and pass downwardly through inward bends 210, 212 so as to converge at the junction of the "Y", thus defining a saddle area 214 between the two tubes. From the junction of the "Y", the first, continuous tube member 40 extends through a reverse bend 216 and downwardly to form the tail piece 32 that acts as the stem of the frame assembly.

The tubular members 40, 42 are joined together in the foregoing relationship by front and rear clamshell clamp pieces 220, 222. Each of the clamp pieces includes a curved channel 224 that extends between semicircular end openings 226*a*, 226*b* and 228*a*, 228*b*, and that is defined by a series of semicircular wall edges 230 that engage and grip the exterior surface of the first tubular member 40 through the area of the "Y" junction. A second set of channels 232 extend inwardly from semicircular end openings 234*a*, 234*b* to similarly accommodate the lower end portion 204 of the second tubular member 42, and likewise include semicircular wall edges 236 that fit against and grip the exterior surface of the latter. In addition, channels 232 of the clamping pieces include transverse pegs 238 that extend through cooperating openings 240 in the blind tube member 42 so as to retain the member against longitudinal movement within the clamp pieces. Semicircular channels 242 on the clamp pieces in turn engage an annular ridge 244 on the continuous tube member 40 so as to accurately position the clamp and prevent longitudinal shifting.

To install the clamp assembly, the pieces 220, 222 are placed over the front and back of the tubular members 40, 42 oriented as shown in FIG. 9, and screws/bolts passed through openings 246, 248 in the clamp pieces and into cooperating threaded portions 250, 252 of the front piece and then tightened, so as to firmly clamp the tube members between the opposing semicircular edges 230, 236 forming the rigid frame structure shown in FIG. 8. A cover piece 254 is mounted to the back of the rearward clamp piece, and includes a passage 256 that accommodates wires 258, 260 and a plug connection 262 leading to the power nozzle.

Figure 30:
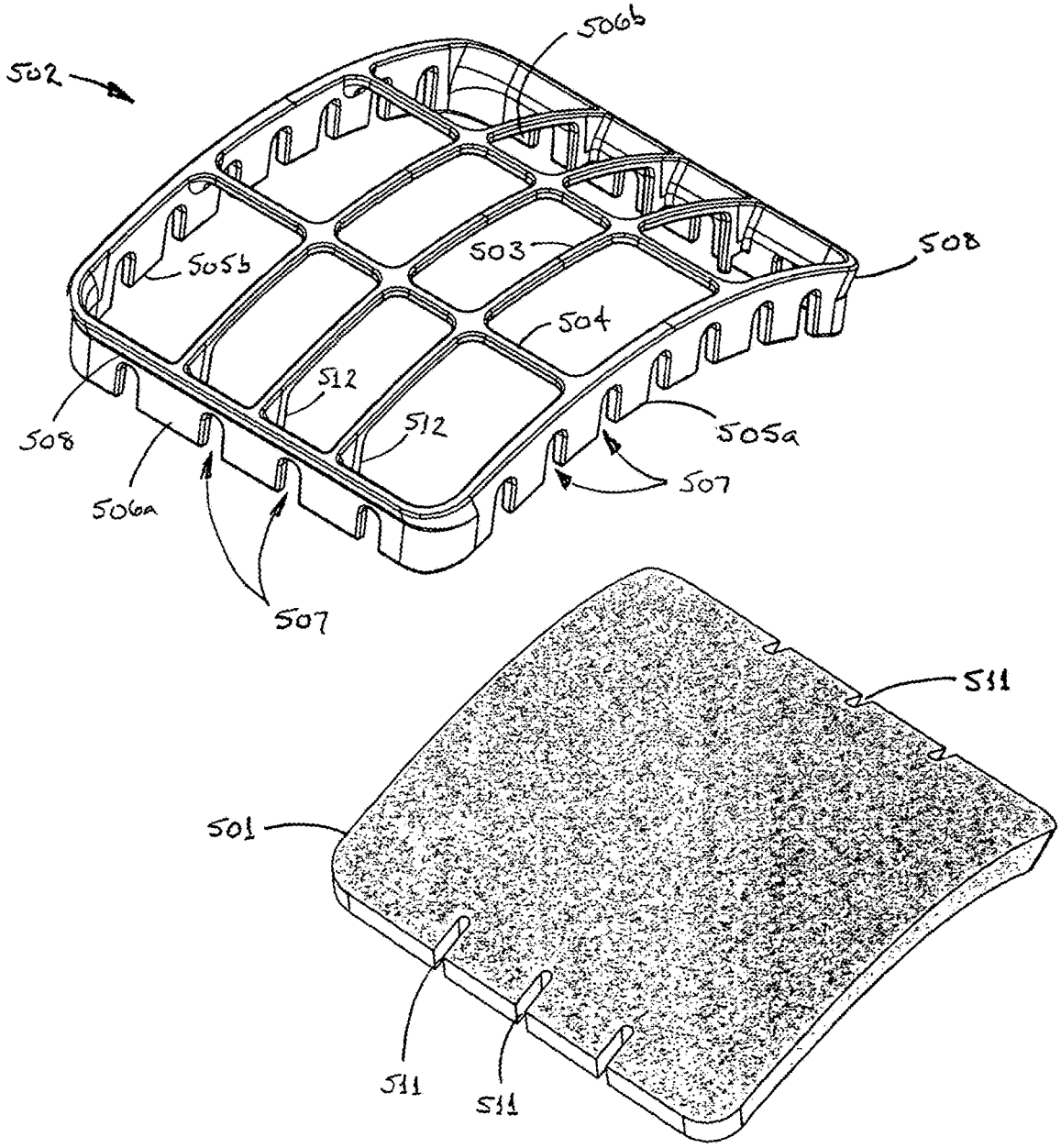
FIG. 30 is perspective exploded view of a pre-filter cage and element that are mounted in the bottom of the bag housing of FIGS. 27 and 29.
Figure 31:
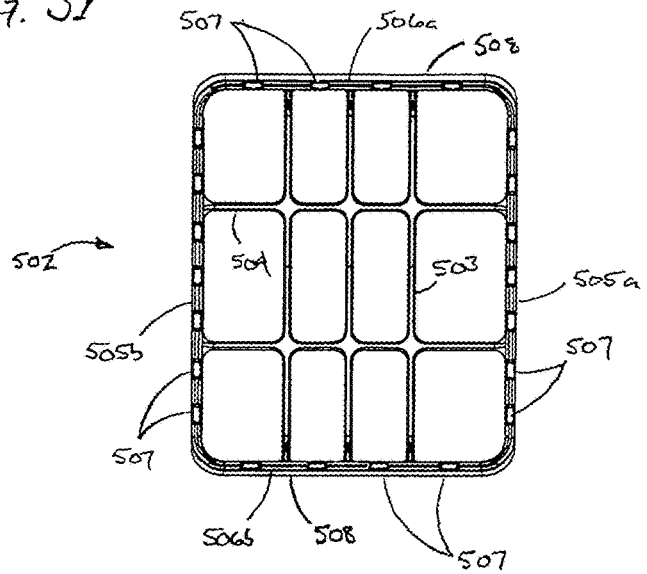
FIGS. 31-33 are, respectively, bottom plan, end elevational and side elevational views of the pre-filter cage of FIG. 30, showing the configuration thereof in greater detail.
Figure 32:
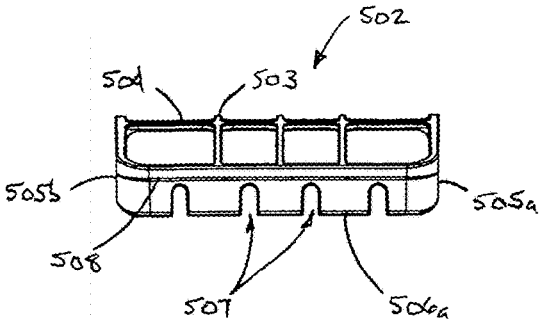
Figure 33:
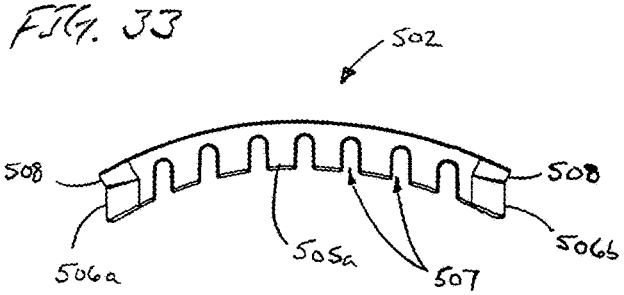

Clamp pieces 220, 222 further include semicircular collar portions 264*a*, 264*b* at base openings 228*a*, 228*b*, that reinforce the channel 242 over ridge 244, and that when installed form a collar of the Y-shaped clamp assembly that abuts the upper end of the elbow assembly. At the upper end of the assembly, pegs 266*a*, 266*b* extend upwardly from bases 220, 222 into the bottom of the saddle area 214. Pegs 266*a*, 266*b* fit into and engage cooperating openings 268*a*, 268*b* in the underside of motor housing 52 (see FIG. 30), within an upward recess 270 that accommodates the upper edges of the clamp pieces. The upwardly extending legs of the tubular members 40, 42, in the areas of bends 210, 212, are in turn received in and engaged by, correspondingly contoured channels 271*a*, 271*b* formed on the rearward sides of housing 52. The upper ends 206, 208 of the tubular members extend into the sides of the exhaust housing 54 that is mounted atop motor housing 52, where they are engaged by clamp assemblies 272*a*, 272*b* as described in greater detail below.

Figure 10:
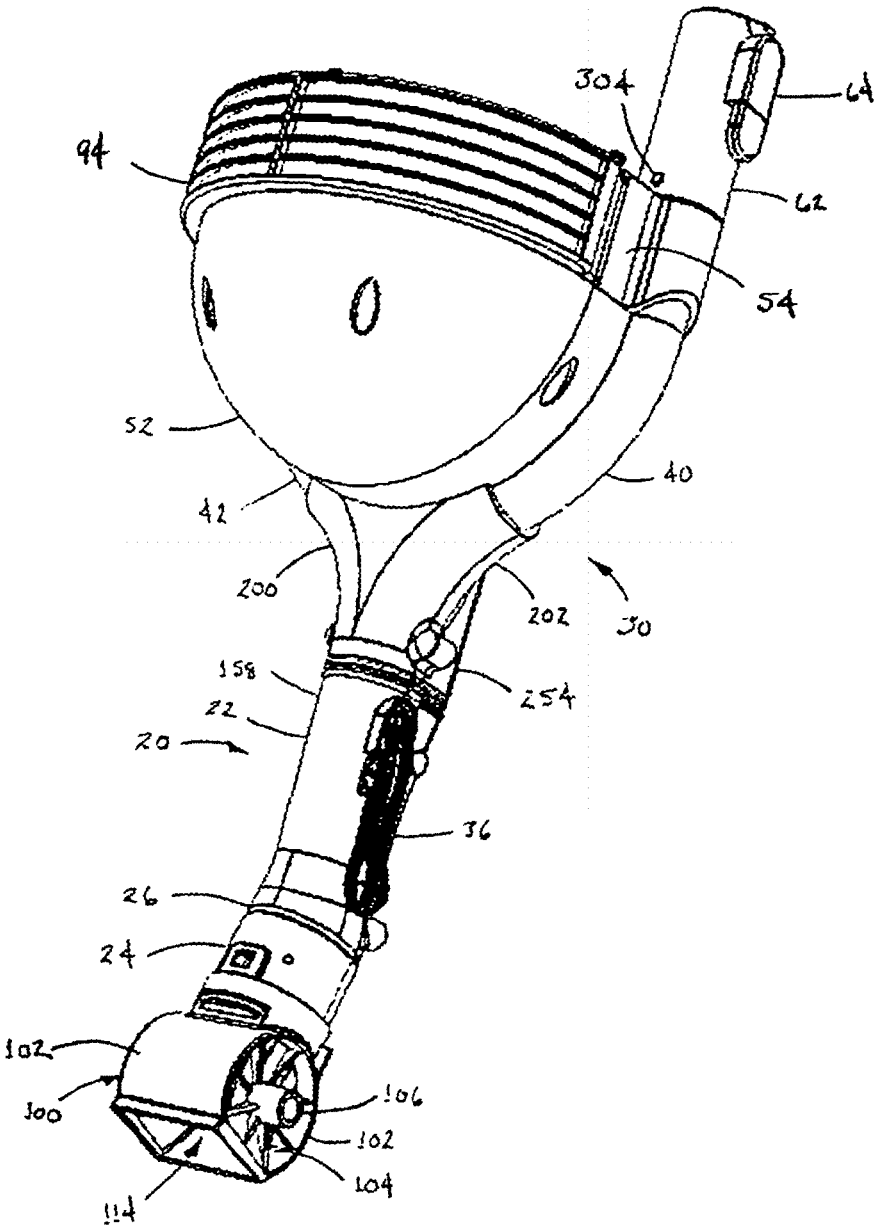
FIG. 10 is a lower front perspective view of the elbow assembly and lower frame section of FIGS. 4-9, showing in greater detail the manner in which these support and engage the lower housings of the body assembly of the vacuum cleaner of FIGS. 1-2.

Thus assembled, as shown in FIG. 10, the Y-shaped lower frame assembly 30 establishes a rigid, durable structure transmitting loads in a side-to-side balanced manner, between the body of the machine and the elbow assembly connected to the power nozzle. Loads are transmitted in turn between the body and handle 84 of the machine by the upper frame assembly 80.

Figure 11:
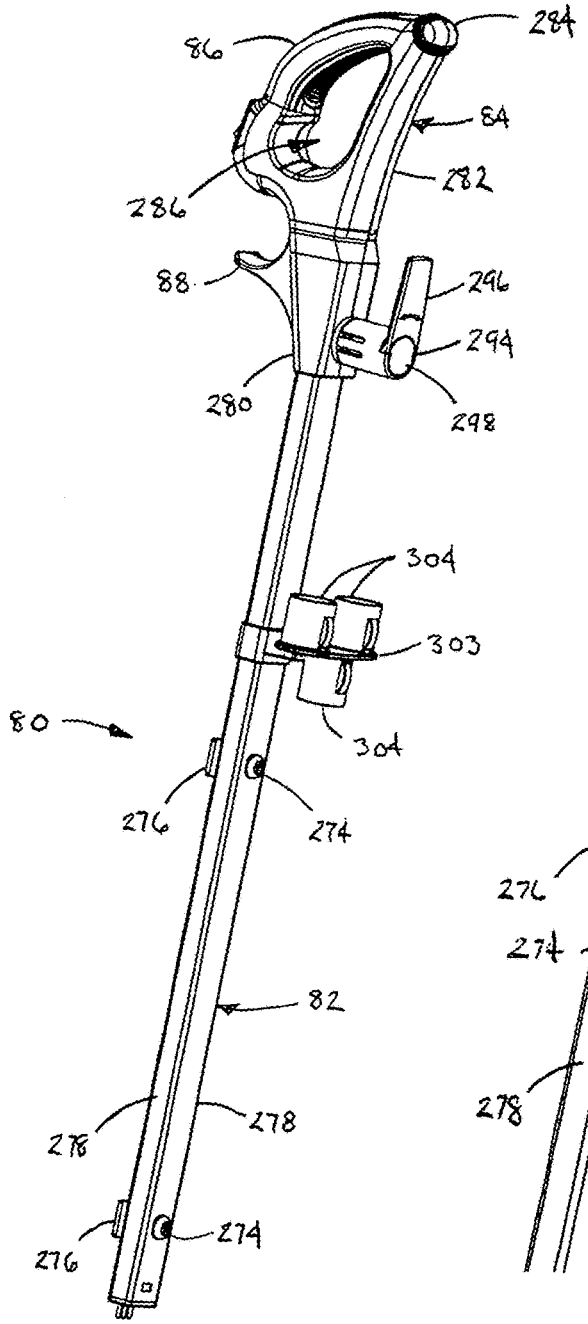
FIG. 11 is a rear perspective view of the elongate bar that forms an upper frame section of the vacuum cleaner of FIGS. 1-2 and the handle assembly that is mounted at the upper end of the bar to enable a user to maneuver the machine.
Figure 23:
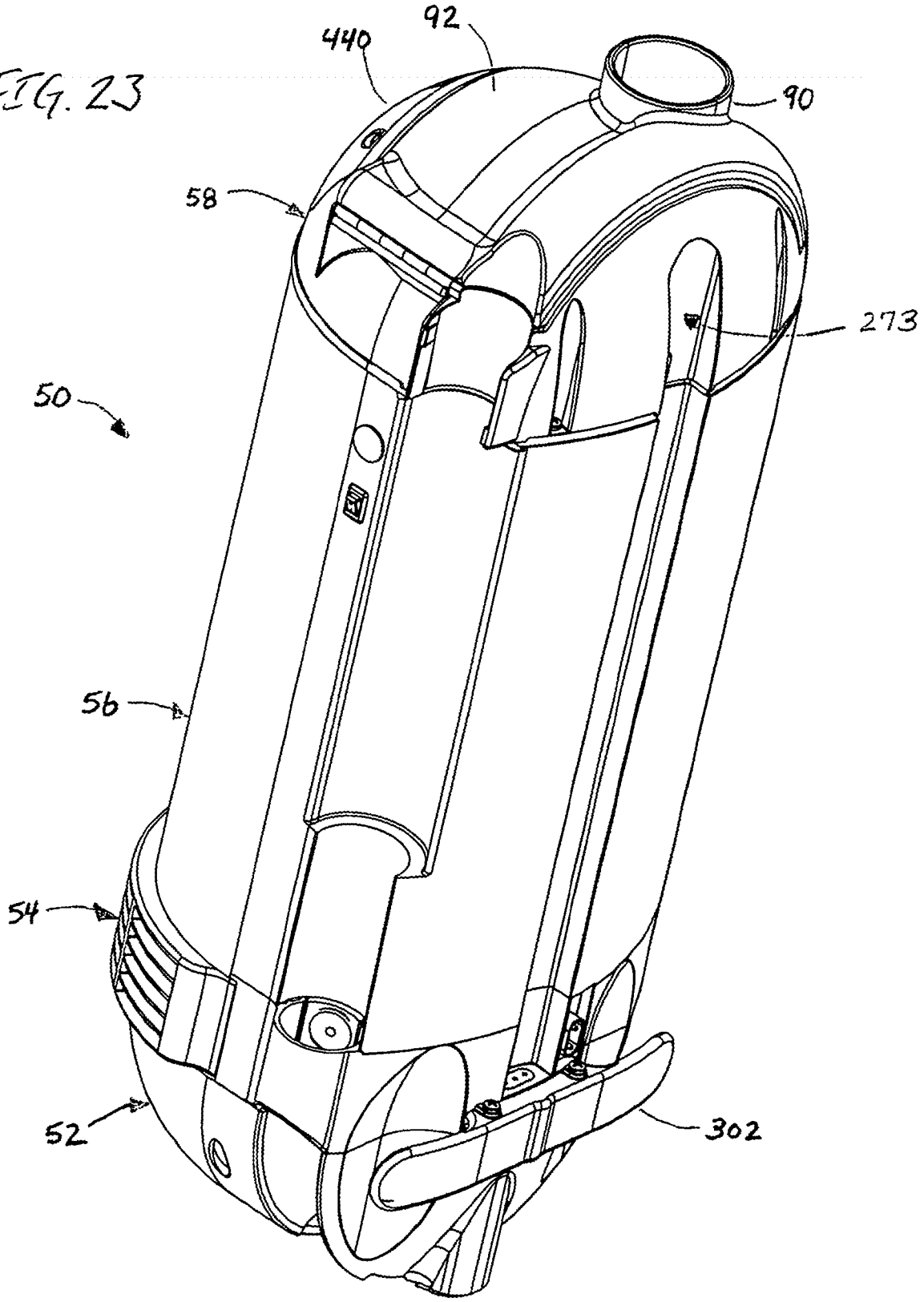
FIG. 23 is a rear perspective view of the body assembly of FIG. 22.

As was noted above and as can be seen in FIG. 11, the upper frame assembly in turn includes an elongate generally vertically extending bar member 82, which is suitably constructed of rectangular cross-section tubing preferably formed of steel or other suitable metallic material. As can be seen in FIG. 23, a generally vertically extending channel 273 is formed in the rearward side of body 50, in which the frame bar 82 is mounted by means of bolts 274 and mounting plates 276; edges of the mounting plates are received in cooperating slot-shaped tracks at the sides of channel 273, so that the height of the bar is adjustable relative to body 50 by slacking bolts 270, sliding the bar to the desired position, and then retightening the bolts. The channel is sized in width to fit closely against the sides 278 of bar 82, to establish a stable, load transmitting engagement between the bar and the body assembly 50.

The base portion 280 of the handle assembly 84 is mounted to the upper end of bar 82, where the latter extends above the upper end of body assembly 50. As noted above, the handle has a somewhat D-shaped configuration, with a more-or-less vertical back leg 282 that extends generally in-line with bar 82 to an upper corner preferably having a cushioned pommel 284, from which the curved grip portion 86 bows forwardly and downwardly and then back inwardly to rejoin the rearward leg 282 proximate base 280, thus defining opening 286 that receives the fingers of the user's hand. The leverage provided by the offset between the grip portion 86 of the handle and axis of bar 82 provides a degree of leverage that aids in maneuvering the machine. To further enhance comfort and ease of use, the topside and underside surfaces of the grip may be provided with resiliently cushioning, "rubberized" pads 288 and 289 preferably having transverse, resiliently flexible ribs, as shown in FIGS. 13-16.

As can be seen in FIGS. 13-16, a suitable power switch 290 is mounted to the forwardly bowed grip portion 86 of the handle, near the forward, lower corner 290 thereof, for convenient operation by the thumb of a user's hand while on the grip portion of the handle. The hook 88 over which the hose is routed protrudes forwardly from the base portion 280 of the handle, in the area below grip 86. A cord dump 294 having a swivel arm 296 and a post 298 is rotatingly mounted to a boss (not shown) on the rearward side of the handle base 280, over which the power cord 300 is wrapped in cooperation with a bracket 302 proximate the lower end of body 50.

In addition, a tool storage bracket 303 is mounted to the back of bar member 82, below the cord dump, and includes a plurality of stub tubes 304 that fit into and engage the connection sleeves of various vacuum tools and accessories, such as crevice tools 305, dust brushes 306, and upholstery brushes 305, for example, so that these tools/accessories can be conveniently stowed and carried on the rearward side of the machine when not in use.

The upper and lower frame assemblies thus cooperate with the rigid body assembly 50 to effectively transfer loads between the handle and the power nozzle of the machine. Moreover, the Y-shaped yoke of the lower frame assembly 30 transfers these loads, as well as the weight of the body and other upper parts of the machine, to the elbow assembly 20 in a manner that is substantially evenly distributed on both sides of the forward-to-back centerline plane of the machine, assuring even loading of the elbow assembly and thus even responsiveness to torque applied by the user's hand when turning left or right relative to the forward-to-rearward plane. In addition, the even loading helps avoid bending and binding forces that could otherwise interfere with the smooth operation and/or service life of the elbow assembly. In the preferred embodiment shown herein, the balanced "Y" structure is achieved using continuous members formed of the same tubular material, which provides advantages in terms of commonality of clamp pieces and other fittings as well as aesthetic benefits, however, it will be understood that in some embodiments the members may be made of different materials or have differing shapes, or may be less than or greater than two in number.

d. Hose Handle Assembly

Figure 17:
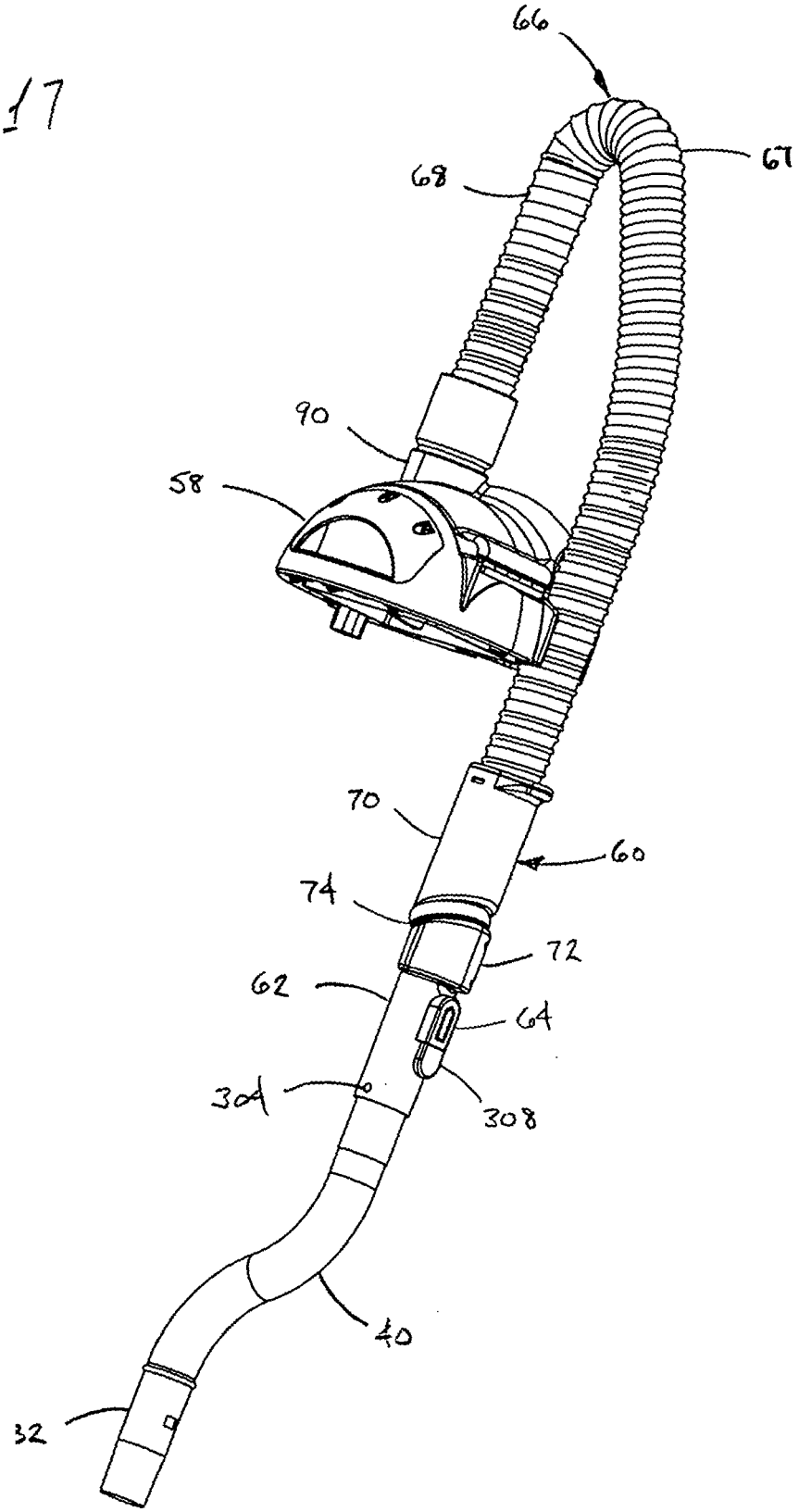
FIG. 17 is a front perspective view of the components of the vacuum cleaner of FIGS. 1-2 that define the flow path from the power nozzle assembly to the top of the body assembly.
Figure 18:
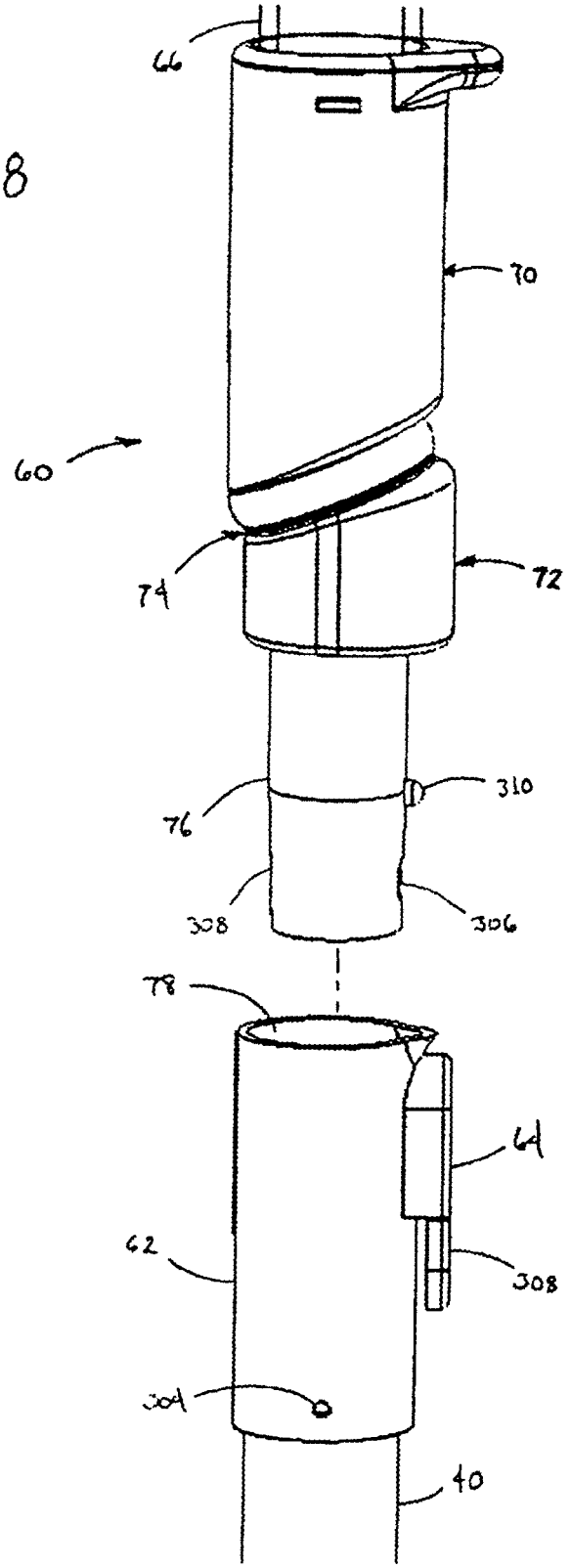
FIG. 18 is a partial perspective view of the hose handle assembly of the vacuum cleaner of FIGS. 1-2 separated from the upper end of the Y-shaped lower frame section thereof.

FIG. 17 shows the components that form the path for the flow of air and suspended particulates, between the elbow and body assemblies of the machine.

As was noted above, the first tubular frame member 40 forms a continuous passage, from the elbow assembly at its lower end 32 to holster-like hose handle holder 62 at its upper end. Holder 62 includes an internal passage that communicates with a corresponding passage in the hose handle assembly 60, from which the flow subsequently enters the flexible vacuum hose 66 and is carried to the hose connection 90 on the lid housing 58 of the body assembly.

Figure 12:
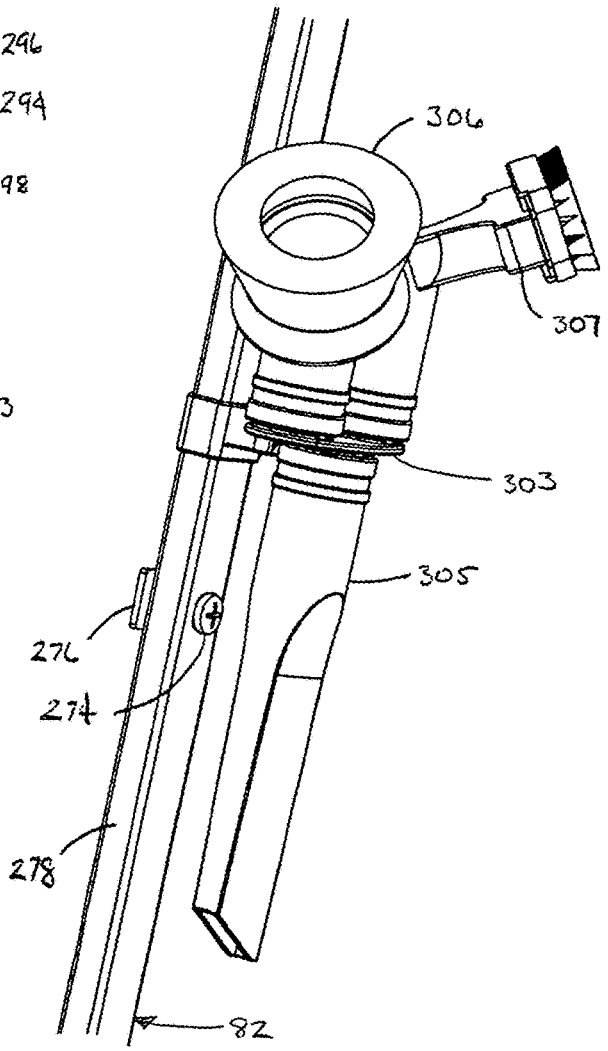
FIG. 12 is an enlarged perspective view of a tool storage bracket mounted on the elongate bar member of FIG. 11, showing the manner in which cleaning tools/accessories are stowed thereon so as to be carried on the vacuum cleaner.
Figure 14:
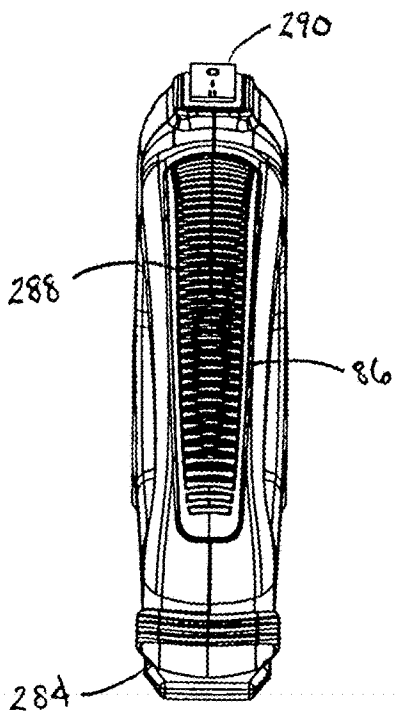
FIG. 14 is a top plan view of the handle assembly of FIG. 13, showing the configuration of the grip portion thereof in greater detail.
Figure 13:
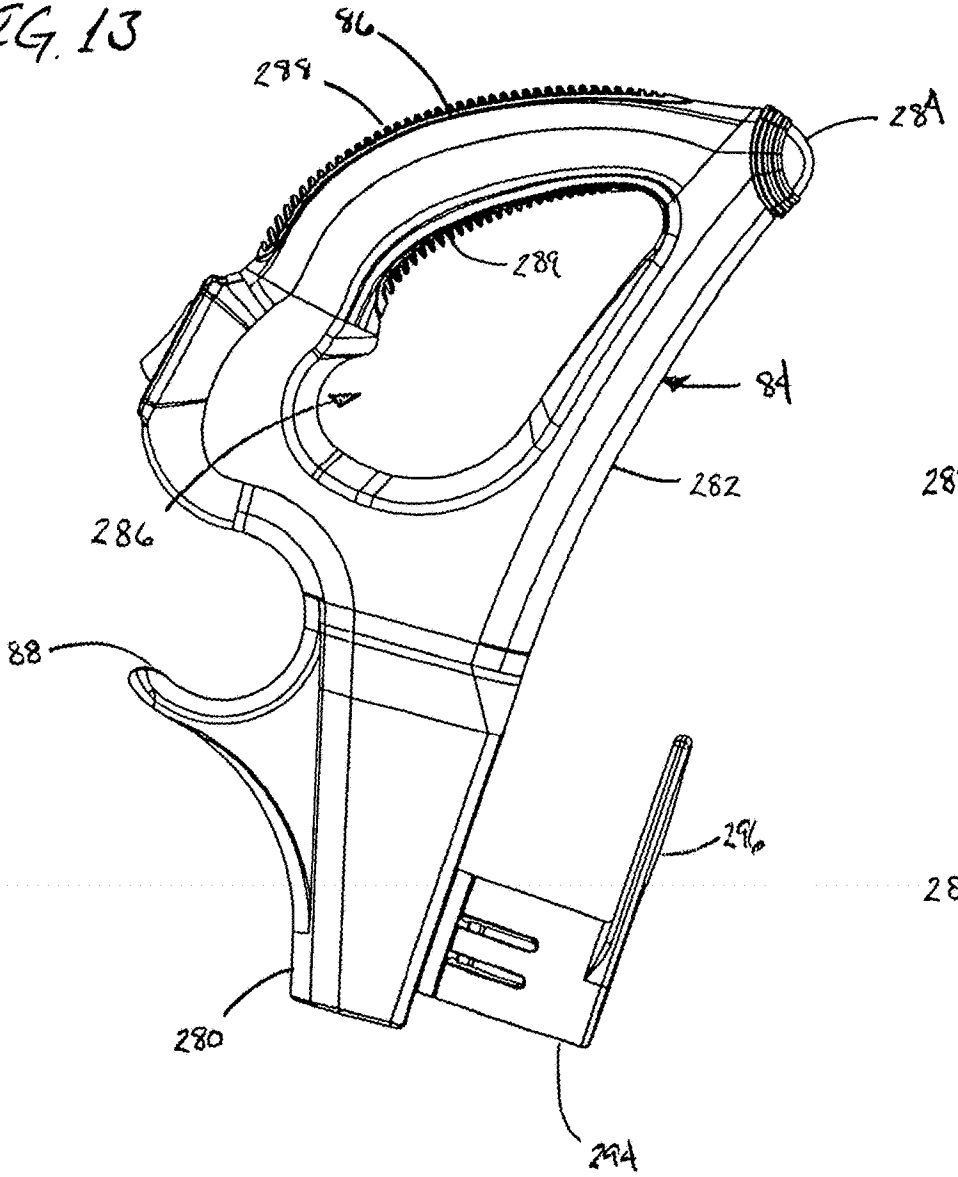
FIG. 13 is a side elevational view of the handle assembly of FIG. 11, showing the structure thereof in greater detail.
Figure 15:
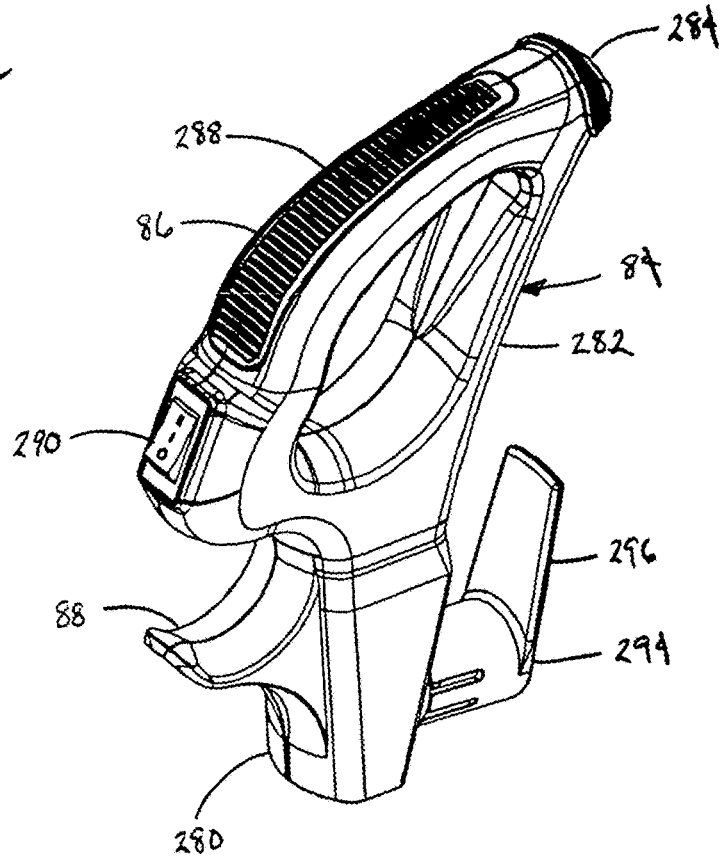
FIG. 15 is an upper front perspective view of the handle assembly of FIGS. 13-14, showing the relationship of the grip portion to the switch and other portions thereof in greater detail.
Figure 16:
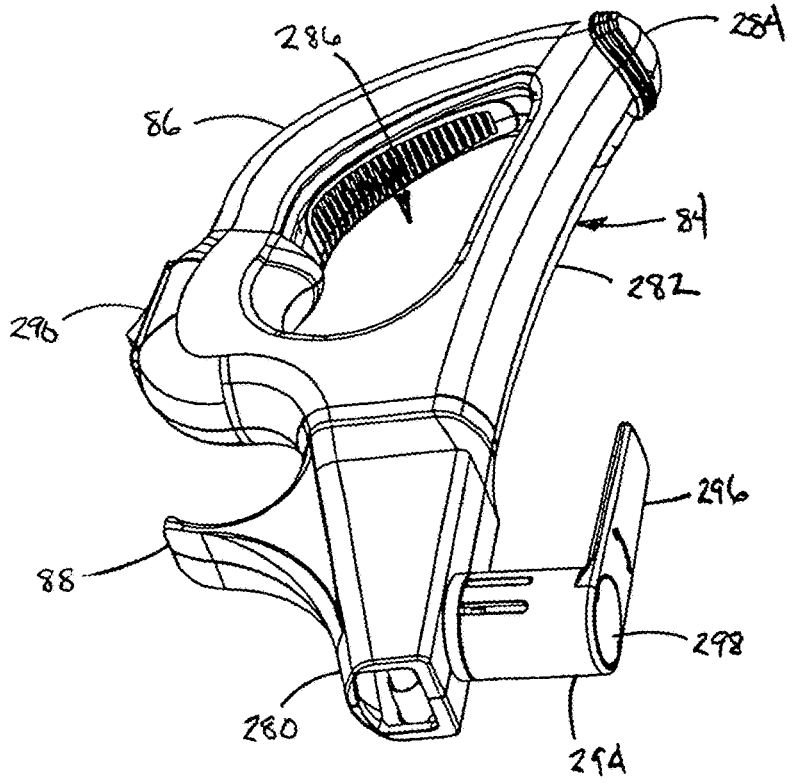
FIG. 16 is a lower rear perspective view of the handle assembly of FIGS. 13-15, showing the lower opening of the mounting portion thereof.

FIGS. 18-21 show the structure of hose handle 60 in greater detail, and also the manner in which it engages the holder 62. As was noted above and as can be seen in FIG. 18, the distal section 72 of the hose handle assembly 60 includes relatively short stinger tube 76 that provides the connection for the vacuum tools/accessories and that fits within the bore 78 of holder 62, and is retained therein by latch 64. Depressing a lever 308 releases the latch mechanism from a cooperating opening 306 in the stinger tube, allowing the hose handle assembly 60 to be withdrawn from the holder as shown in FIG. 12. The exposed stinger is thus freed to be inserted into the hose connections of various tools and accessories, such as a crevice tool or upholstery brush as noted above, and preferably includes a taper 308 to aid insertion into the connector sleeves/necks of the vacuum tools/accessories as well as a depressible spring-loaded latch button 310 that engages cooperating openings on the tools/accessories to releasably lock the latter on the stinger tube.

Figure 19:
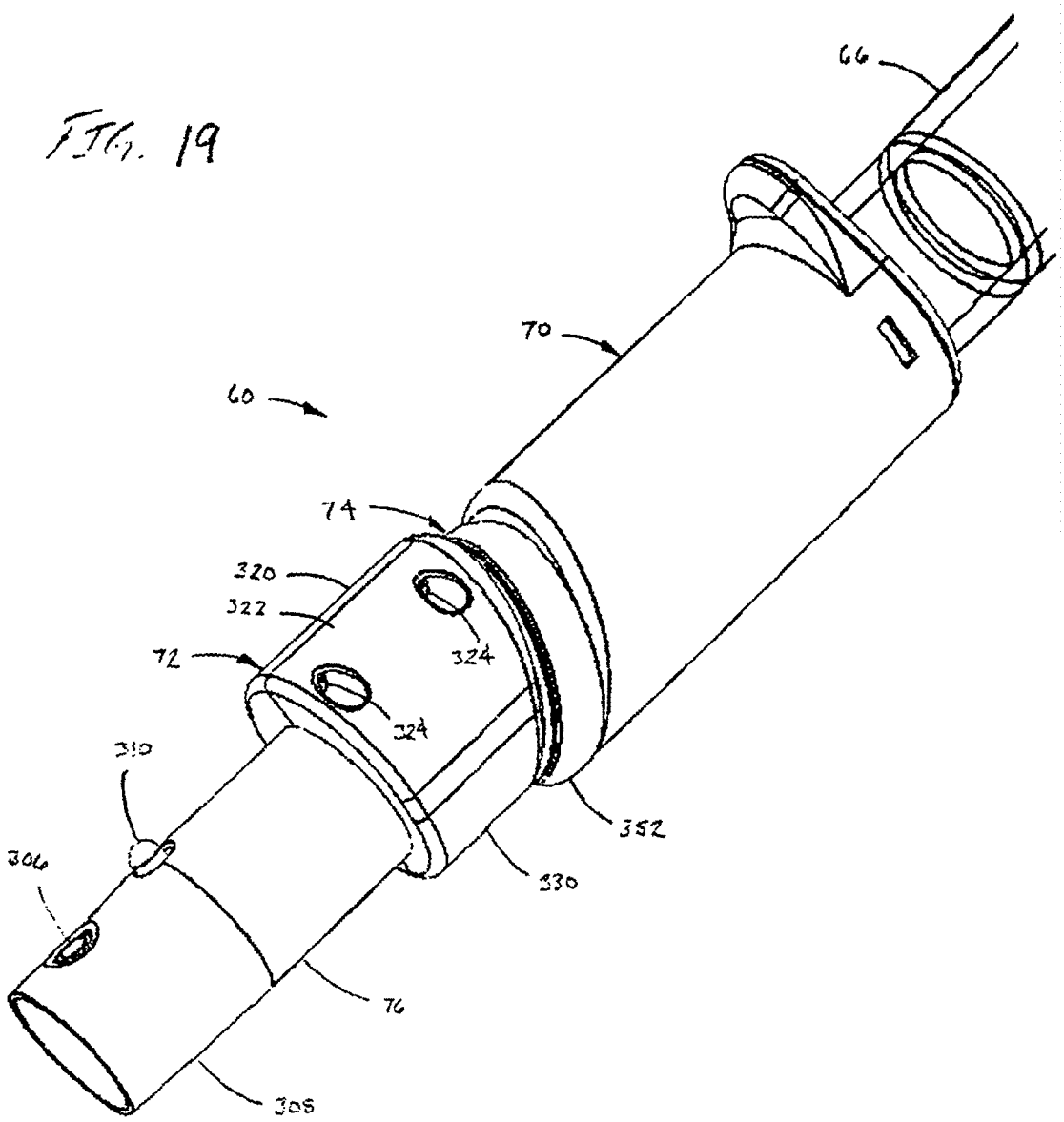
FIG. 19 is a second perspective view of the hose handle of FIG. 18, showing the intake tube thereof to which cleaning tools and accessories are detachably connected.
Figures 21A, 21B, 21C:
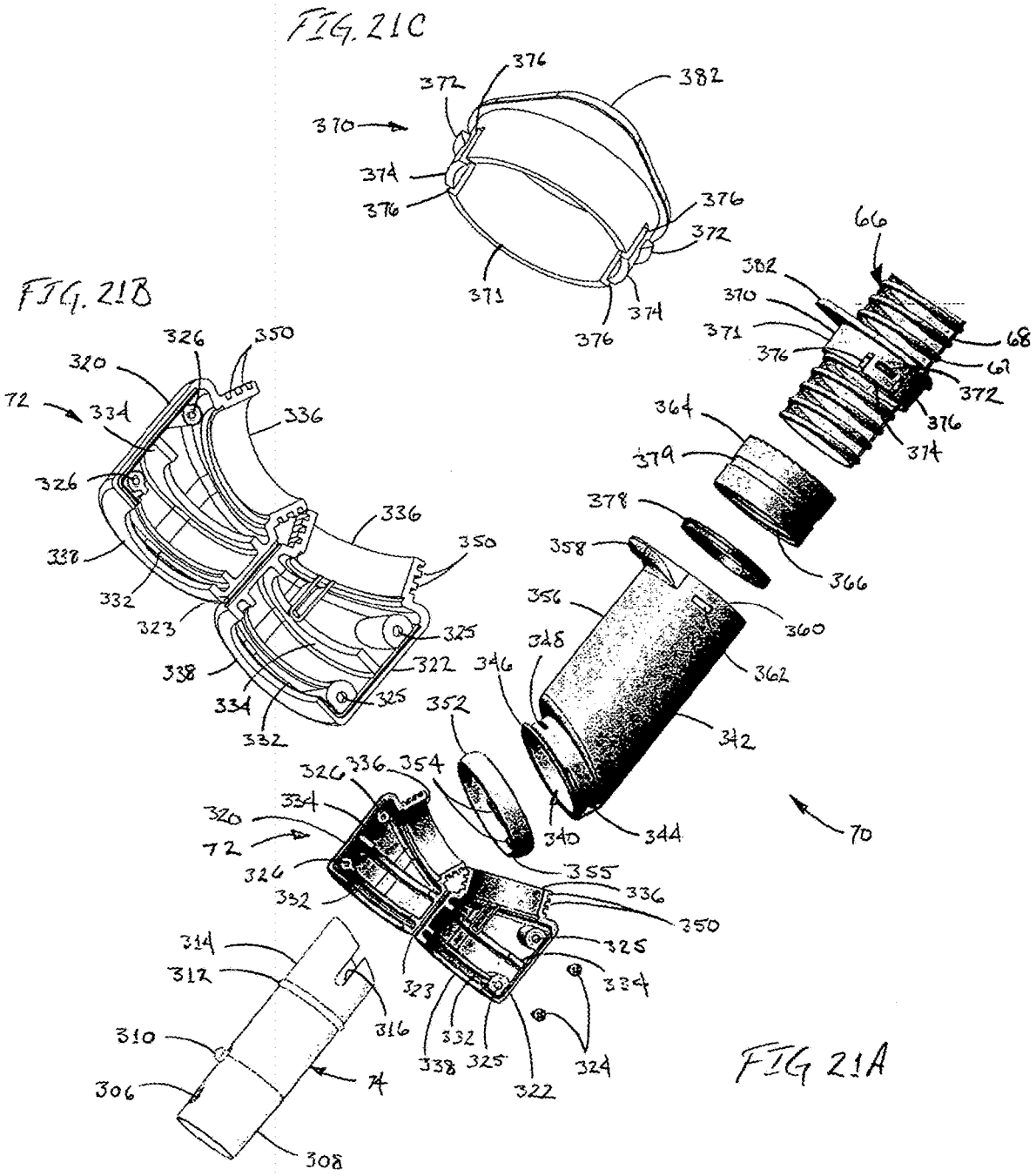
FIG. 21A is an exploded view of the hose handle assembly of FIGS. 12-13, showing the components thereof in greater detail
FIGS. 21B and 21C are, respectively, enlarged views of the lower handle portion and hose retainer of the assembly of FIG. 21A.

As can be seen in FIGS. 19 and 21, the stinger tube 74 further includes a raised annular ridge 312 and a base portion 314 extending rearwardly of the ridge, the base portion including a slot 316 that extends longitudinally from the end opening of the tube. The base portion 314 is clamped between first and second hemi-cylindrical clamshell halves 320, 322, that are joined on one side by a molded hinge 323 and secured together on the other by screws 324 threaded through passages 325 into bores 326 to form a generally cylindrical grip member 330. The annular ridge 312 on the stinger tube is captured in semi-circular channels 332 in the two grip halves so as to hold the tube in place longitudinally, while an indexing peg (not shown) on the inside of clamp half 322 is received in slot 316 to hold the tube against rotation. As can be seen in greater detail in FIG. 21B, the clamp halves additionally including interior strut walls having semi-circular edges 334 that engage the base portion 314 of the stinger tube to maintain the latter in stable axial alignment with the grip member 330.

As can be seen with further reference to FIG. 21A, the discharge ends 336 of the clamp halves 320, 322 form a neck that extends at an angle to the axis of the intake end 338 of stinger tube 74. With the clamp halves 320, 322 assembled, the discharge end neck is sized to fit coaxially within an opening 340 in the intake end of the handle member 342 of upper sections 70, so as to form a rotating engagement between the two pieces. The opening 340 is surrounded by an annular channel 344 formed behind an annular end flange 346. A series of short, circumferentially extending slots 348 are formed in channel 340, at longitudinally spaced distances from flange 346, and align with correspondingly spaced annular grooves 350 formed about the neck of grip member 330. A retainer ring 352 is received in channel 344, and includes a plurality of circumferentially extending teeth 354 that pass through slots 348 to engage the grooves 350, thereby locking grip 330 longitudinally on handle 342 while at the same time allowing the two parts to rotate relative to one another; the locking ring 352 has a split 355 in its circumference and is formed of a resiliently flexible material, so that after the neck of the lower section 72 has been inserted in the opening 340 of the upper section 70 ring 352 can be spread slightly and slid into place in channel 344.

As can be seen in FIG. 21A, the axis of opening 340, and therefore the axis of rotation of grip 330 extends at an angle to the main tubular body 356 of handle 342, preferably the same angle as between the neck of grip 330 and the stinger tube 74, so that the latter can be rotated to various angles from a starting orientation parallel to handle 342 to a maximum angle thereto as defined by the axis of rotation, as shown in FIGS. 20A-20B.

The tubular body 356 of the base section of the assembly includes a laterally protruding finger rest 358 located proximate its rearward/discharge end opening 360, and a radial notch opening 362. The cylindrical end opening 360 is sized to receive a cooperating cylindrical plug member 364 mounted on the end of the flexible vacuum hose 66. The plug member includes a bore having internal threads 366 that cooperatingly engage spiral ridges 67 and grooves 68 formed by the winding of hose 66 so as to allow the plug member to be threaded onto the latter, thereby allowing a full swivel action of hose 66 inside handle 342. A retainer 370 is fitted over vacuum hose 66 behind end plug 364 and includes a cylindrical sleeve 371 through which the hose passes in freely rotatable relationship. The cylindrical sleeve of the retainer is received in the end opening 360 of the handle member 342, and as can be seen in greater detail in FIG. 21C, includes a laterally projecting tooth 372 on a resiliently flexible tab portion 374 defined by edge slots 376. The tooth 372 is sized to be received in the notch opening 362 of the handle member 342 and includes a beveled leading face, so that in response to the end fitting 364 and locking ring 370 being pressed into opening 360 tab 374 depresses to permit the locking tooth to pass under the edge of opening 360 and then spring out resiliently into locking engagement with opening 362, thereby coupling the hose to the handle member. An annular sealing ring 378 seated in a groove 379 on the plug member cooperates with the internal bore of the handle member to insure integrity of the flow path, which enters the hose via end opening 380. A laterally extending alignment flange 382 is in turn received in a recess (not shown) in the rearward side of finger rest 358, to hold the retainer against rotating relative to the handle member and thereby minimize stress on the locking tooth 372.

Thus assembled, the handle 342 when gripped by a user can conveniently rotate on the end of vacuum hose 66 without twisting the latter, while at the same time the stinger tube and any cleaning tool/accessory mounted thereon and be adjusted through a full range of angles, from straight to the maximum angle defined by the axis of pivot joint 24. This provides the user with a great detail of flexibility in positioning and angling the tool/accessory as may be desired for a particular cleaning task, such as cleaning crevices and furniture, various angled surfaces, and so on.

e. Body Assembly

As was noted above and as can be seen in FIGS. 22-23, the body assembly includes motor housing 52, exhaust housing 54, bag housing 56 and lid housing 58, mounted atop one another in a generally stacked arrangement. The overall flow path through the body assembly is from the hose connection 90 on lid housing 58, downwardly through the bag housing to the motor housing 52, from which the flow is discharged via the exhaust housing 54.

Figure 24:
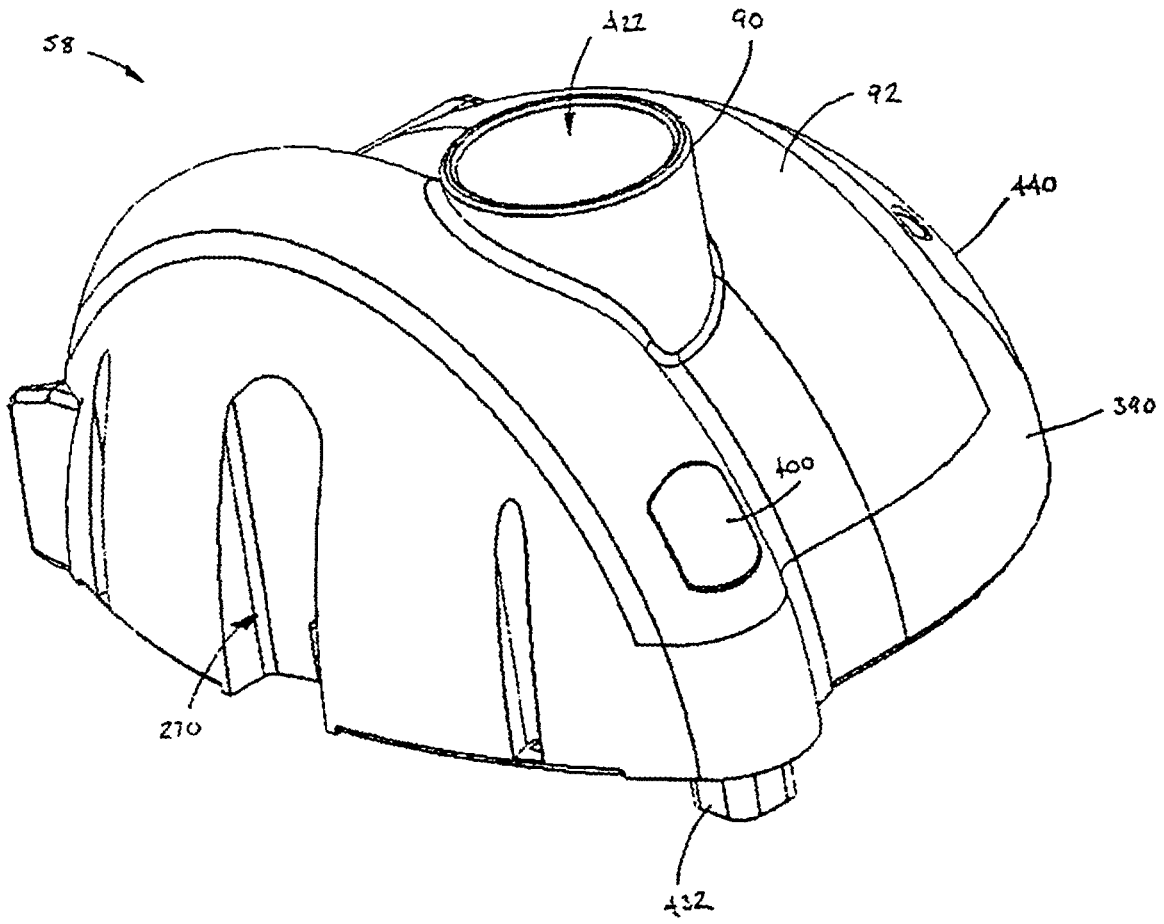
FIG. 24 is a top rear perspective view of the lid housing of the body assembly of FIGS. 22-23.
Figure 25:
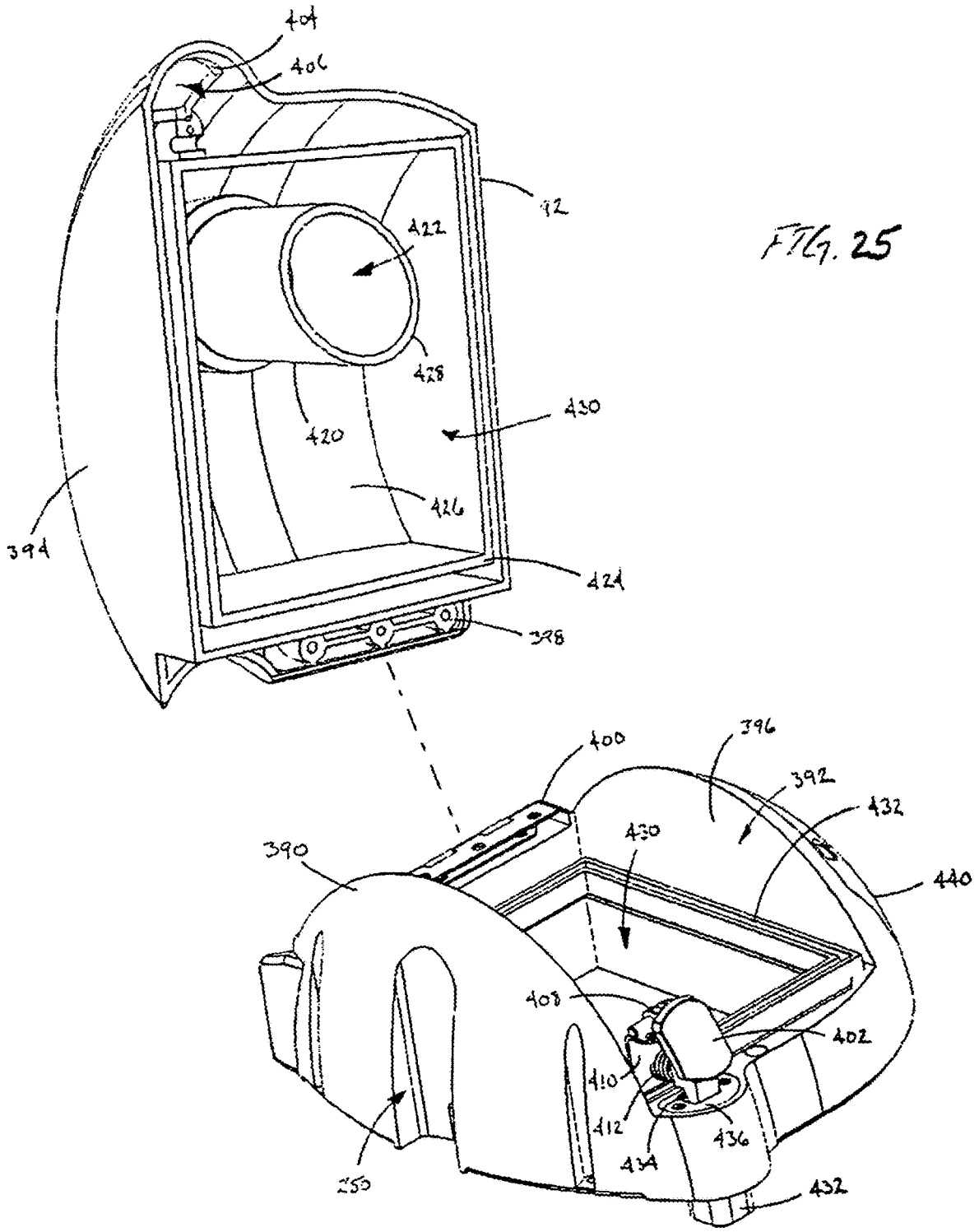
FIG. 25 is a rear perspective view of the lid assembly of FIG. 24, with the pivoting and stationary portions thereof separated to show the structure in greater detail.
Figure 26:
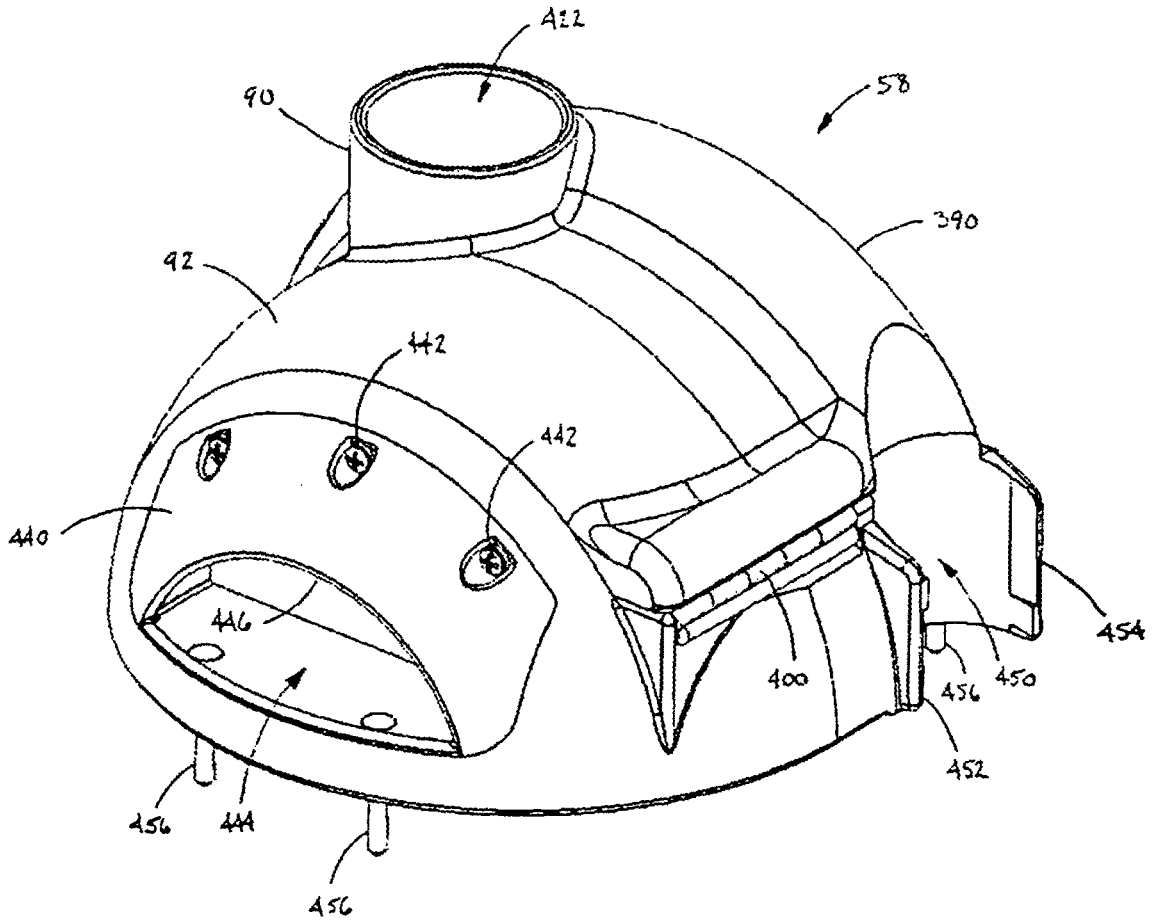
FIG. 26 is a front upper perspective view of the lid housing of FIGS. 24-25.

As can be seen in FIGS. 24-26, the lid housing 58 includes a fixed shell 390 that forms an enclosure at the upper end of the body assembly. A lid member 92 is set within a recess 392 in shell 390, with planar side surfaces 394 of the lid member fitting between corresponding surfaces 396 of the recess. A base edge 398 of the lid member is joined to shell 390 by a hinge 400 that permits the lid to be pivoted between closed and opened positions. A latch button 402, mounted on shell 390 on the side of recess 392 opposite hinge 400, releasably engages an edge 404 of a cooperating opening 406 on the lid member to retain the latter in the closed position; the latch button is pivotally mounted to shell 390 by a hinge 408 on a bracket 410, with a coil compression spring 412 being disposed between the button 402 and bracket 410 so that the lid can be released by applying finger pressure to depress the button out of engagement with the edge of opening 406.

The hose connection 90 noted above is formed in the lid member 92 by a tubular stub pipe 420 having an internal passage 422 that establishes a flow path from the hose through the interior of the lid. A rectangular wall 424 depends from the inside upper surface 426 of the lid so as to surround the lower, discharge end of the pipe segment 428 so as to define an enclosure 430 continuous with a vertical opening 426 through the bottom of shell 390 that leads to the interior of the bag housing, as will be described in greater detail below.

When the lid 92 is in the closed position the lower edge of its round wall 424 seats against a gasket (not shown) in a rectangular channel 432 formed in shell 390 around opening 430 so as to form a seal between the opening and plenum area 430. Vacuum applied to the bag housing and communicated through opening 426 is thus contained within enclosure 430, so that the vacuum is applied via passage 422 to the hose attached to connection 90. The lower end of pipe segment 428 conveys the resulting flow of air and particulate matter to the collection bag in the underlying bag housing, via a cooperating opening in a top panel of the bag. Then, from time-to-time, with the vacuum blower de-energized, the lid member 92 can be opened to remove/replace the particulate collection bag as needed.

A secondary "bleed air" flow path is provided by a comparatively small-diameter tube 432 that depends from shell 390 and is in indirect communication with the interior of the bag housing. Clean exterior air is drawn into the bleed air tube through a gap around the edges of opening 406 and also through an opening 434 in the striker/stop plate 436 of the latch button 402, and is supplied to a UV ozone/negative-ion generator in the bag housing as will be described in greater detail below.

As can be seen with further reference to FIG. 26, the lid housing of the illustrated embodiment also includes a lifting handle 440, that is suitably formed as a separate moulded piece mounted to shell 390 by screws 442. The lifting handle includes a laterally extending opening 444 that accommodates the user's fingers, and a curved upper lip 446 that provides a secure grip for lifting the machine.

As can also be seen, a vertically extending, concave channel 450 is formed in one side of the lid housing, that accommodates vacuum hose 66 when the latter is in its normal operating position. The channel 450 is bordered by first and second inwardly curved wing walls 452, 454 having edges that are spaced apart by a distance slightly less than the diameter of the hose, so as to cooperate with the resiliently flexible material of the hose to releasably retain the latter in the channel.

Figure 22:
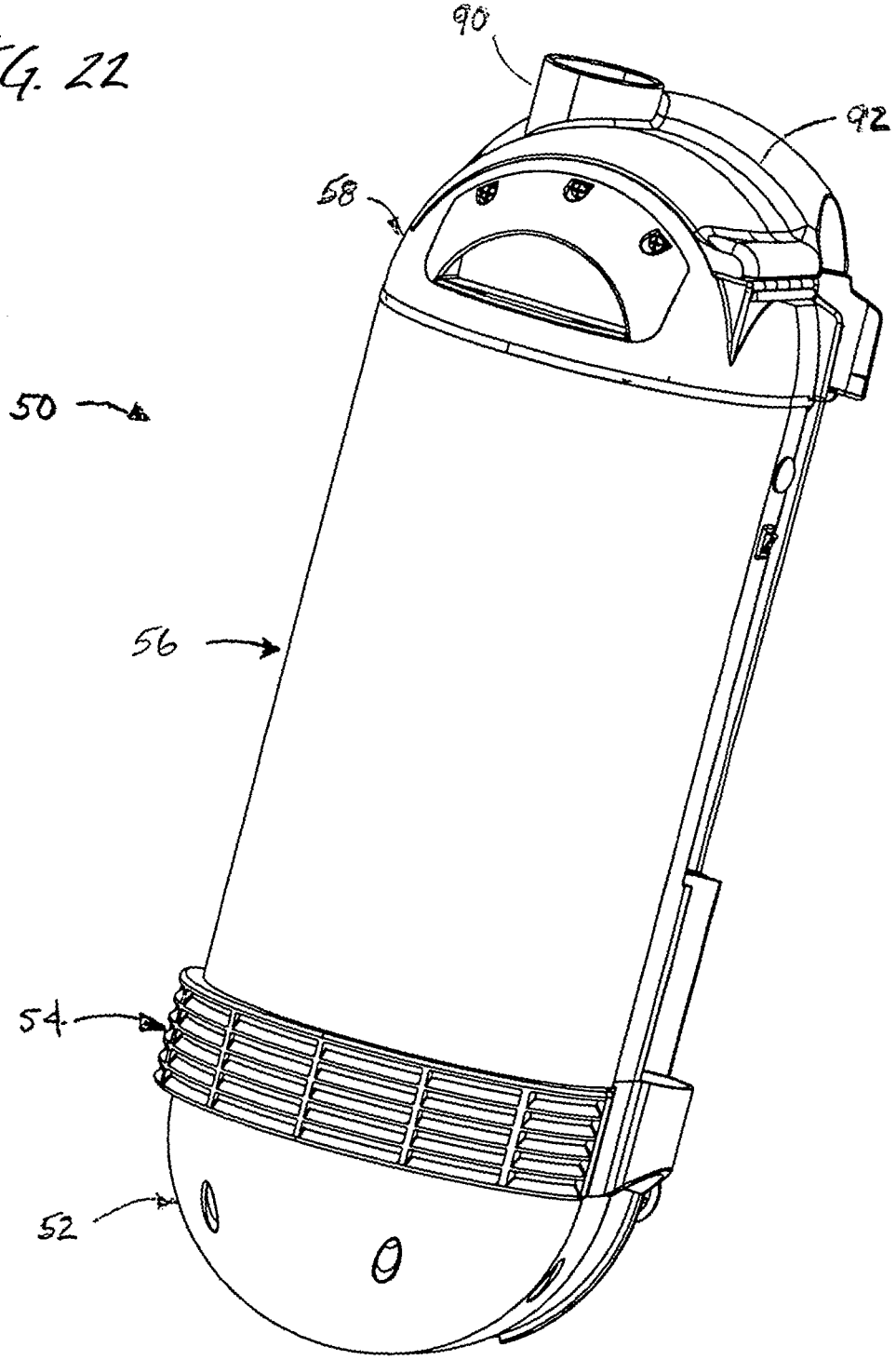
FIG. 22 is a front perspective view of the body assembly of the upright vacuum cleaner of FIGS. 1-2.

FIG. 26 also shows screws 456 that mount the lid housing atop the bag housing 56. As can be seen in FIGS. 20 and 22, the bag housing has an open upper end 460 with a peripheral, inwardly-directed lip or flange 462, that forms a seal with a corresponding lip of the lid assembly 58 when the latter is installed thereon, by means of the screws 456 being threaded into bores 464 in the shell 466 of the bag housing.

Figure 27:
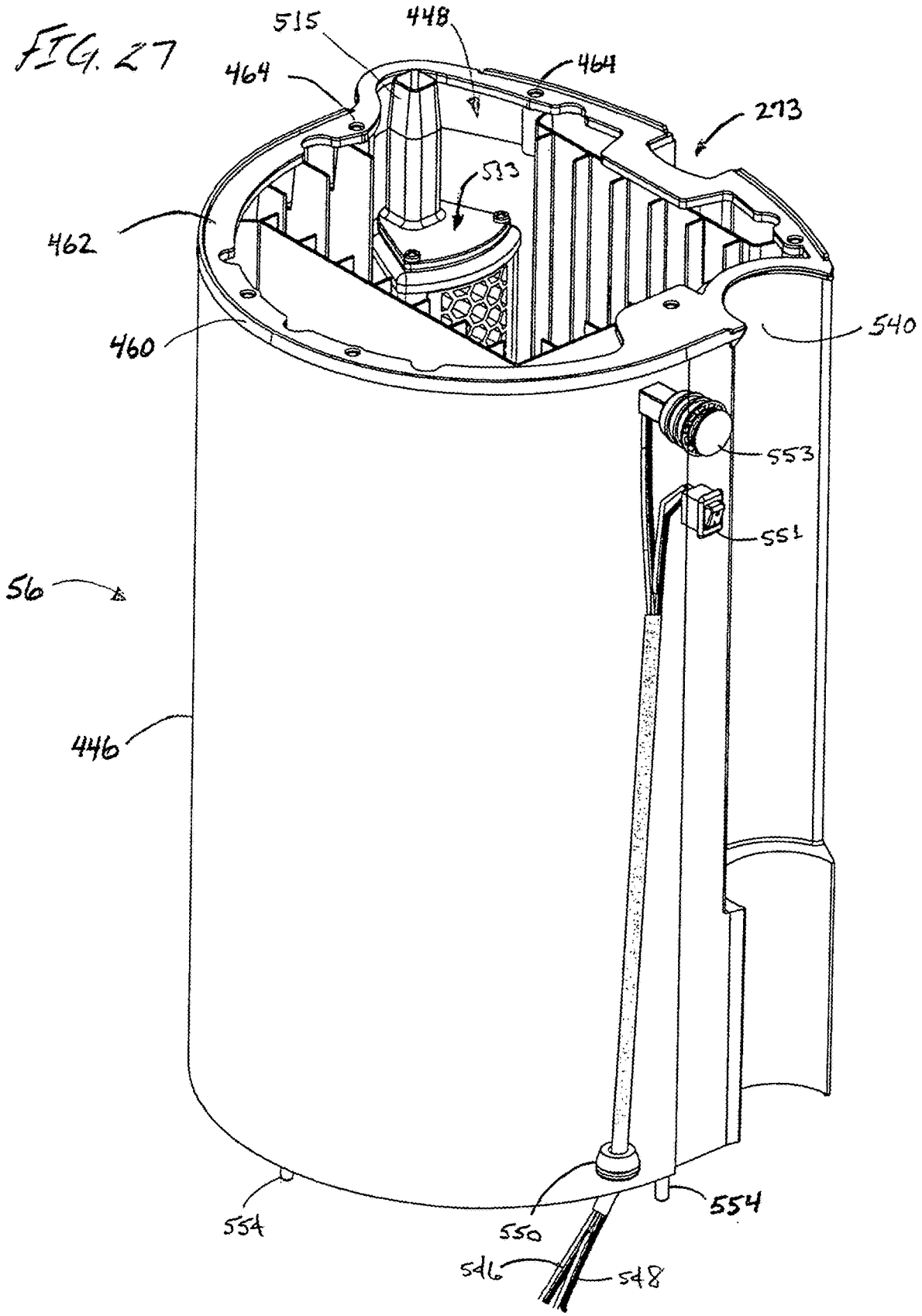
FIG. 27 is a front upper perspective view, partially in phantom, of the bag housing of the body assembly of FIGS. 22-23.
Figure 28:
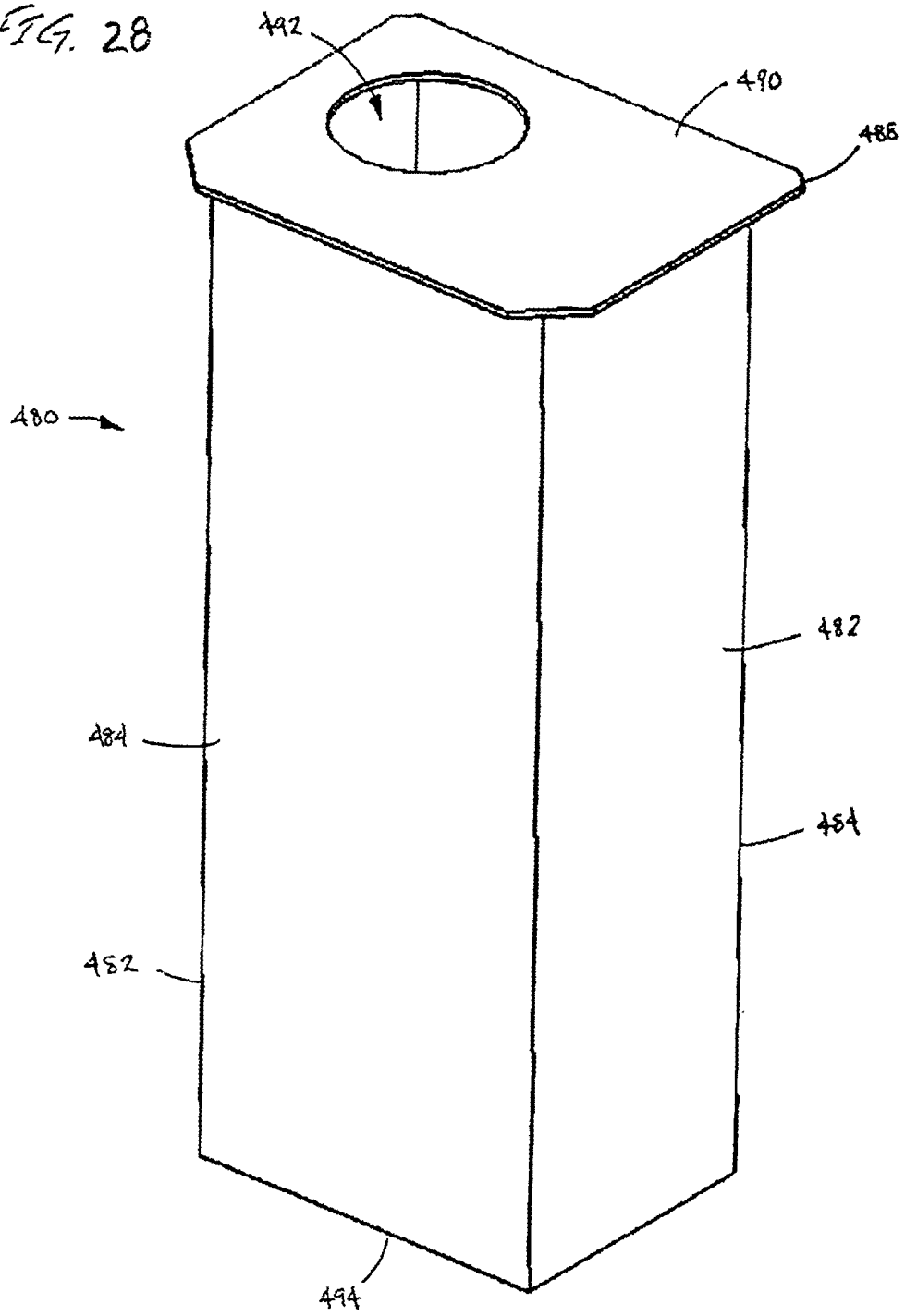
FIG. 28 is an upper front perspective view of the particulate collection bag that is received in the bag housing of FIG. 27.
Figure 29:
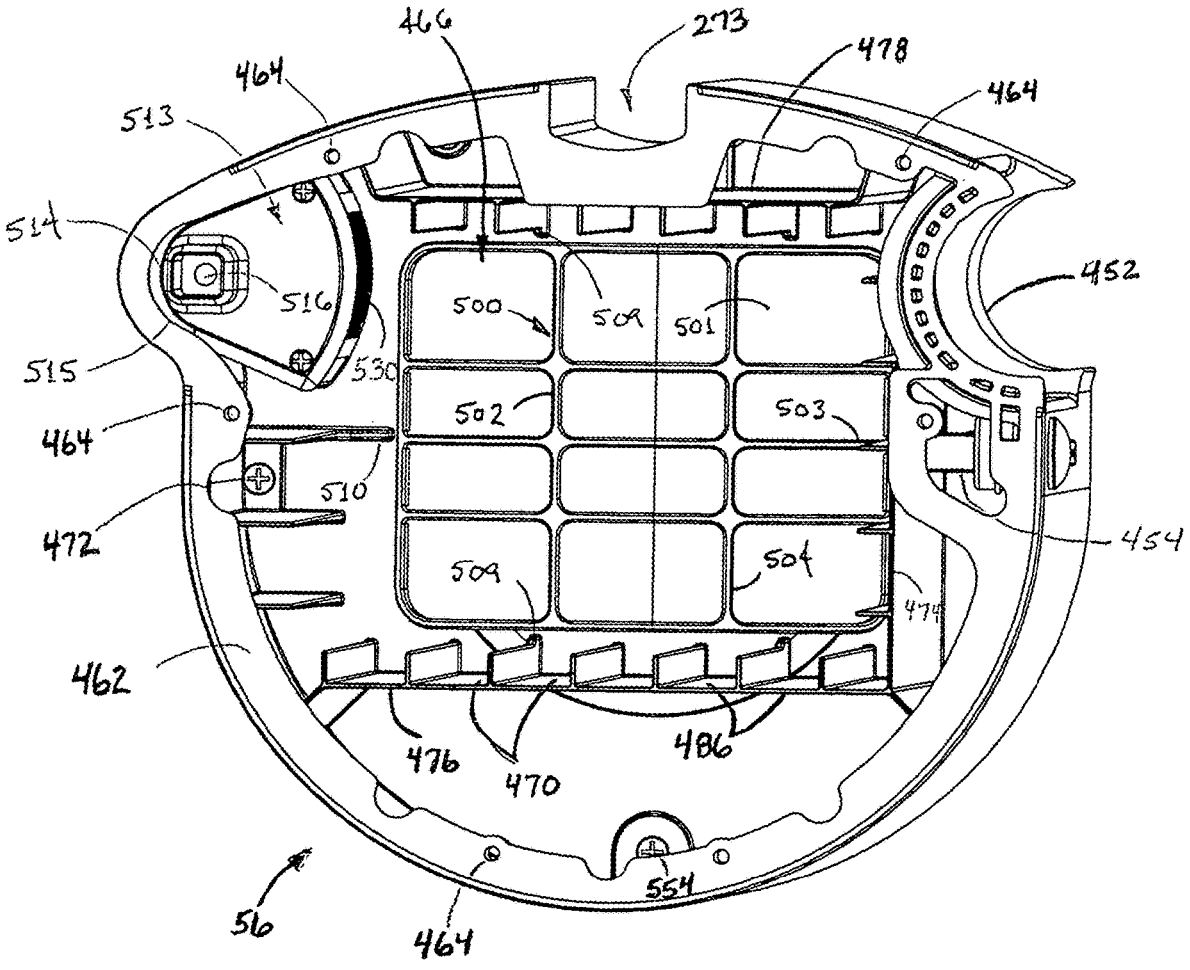
FIG. 29 is a top perspective view of the bag housing of FIG. 27, showing the internal structure and features thereof in greater detail.

As can be seen with further reference to FIGS. 27-29, the open upper end 448 of the bag housing leads into a generally rectangular chamber 466 defined by the edges of ribs 470 that project inwardly from side panels 472, 474 and front and rear panels 476, 478 mounted inside the shell 460 of housing 56. Chamber 466 is sized to receive a particulate collection bag 480, as shown in FIG. 21. On each side of chamber 466 the edges of the inwardly projecting ribs 470 lie substantially in a common plane corresponding to that of the adjoining side of the rectangular bag 480, thus providing support to maintain the shape of the medium (typically paper) of the bag and providing a stand-off that permits air to flow outwardly on all sides of the bag through channel areas 486 that are formed intermediate the ribs.

A projecting lip 488 of the top panel 490 of the particulate collection bag rests atop the upper ends of ribs 470 so as to support the bag vertically in chamber 466. Airflow, including suspended particulate, enters the collection bag from the discharge end of pipe segment 422 through opening 492, and after the particulate has been extracted the airflow passes outwardly through the side walls of the bag and then downwardly through the channels 486 between walls 470, and also outwardly through the bottom panel 494.

As can be seen in FIG. 29, a pre-filter 500 is mounted in a bottom opening of housing 56, to further remove particulate from the airflow prior to entering the vacuum blower. The pre-filter includes a filter element 501 suitably formed of a paper, foam or fiber filter medium, housed within a cage 502 having longitudinal and lateral crossbars 503, 504 that maintain an airflow space beneath the bottom panel 494 of the filter bag and also protect the filter element against damage during bag changes.

Figure 35:
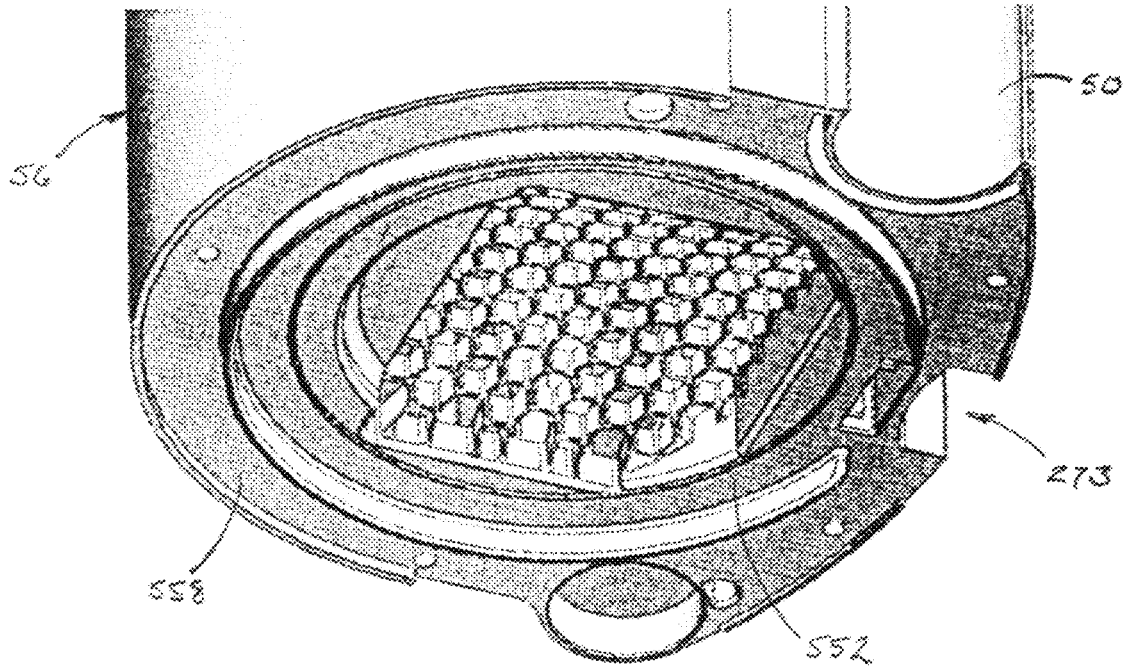
FIG. 35 is a partial lower perspective view of the bag housing of FIGS. 27-29 showing the surface and other features that mate with the underlying exhaust housing of the body assembly.

As can be seen in FIGS. 30-33, the pre-filter cage 502 is preferably upwardly domed, with the filter element 501 and the bottom wall of the housing being correspondingly upwardly convex and preferably provided with a sturdy "honeycomb" or similar grill as shown in FIG. 35. The domed configuration provides the cage and filter with greater strength against vertical loads, for example, against being damaged by an article that may be accidentally dropped through the top opening of the housing while changing filter bags. Depending side walls 505*a-b* and end walls 506*a-b* extend downwardly to define an interior volume for holding the pre-filter element, and include generally vertically extending slots 507 that allow air to reach the filter element from the sides as well as through the upper grate. The upper edges of the side walls 505*a-b* react against inwardly protruding step portions 509 at the lower ends of ribs 470 to center the pre-filter assembly side-to-side when being installed; outwardly flared upper edges 508 of the end walls similarly react against inwardly stepped portions 510 of the ribs to center the pre-filter assembly longitudinally, and also act as grip areas for the thumb and fingers of a user's hand when removing/installing the pre-filter assembly. The filter element 501 is in turned retained within cage 502 by frictional engagement between slots 511 formed in edges of the filter element and cooperating inwardly-projecting flanges 512 at the bases of crossbars 503, so that the filter element is easily pulled out of the bottom of the cage for cleaning/replacement when desired.

Figures 34A, 34B:
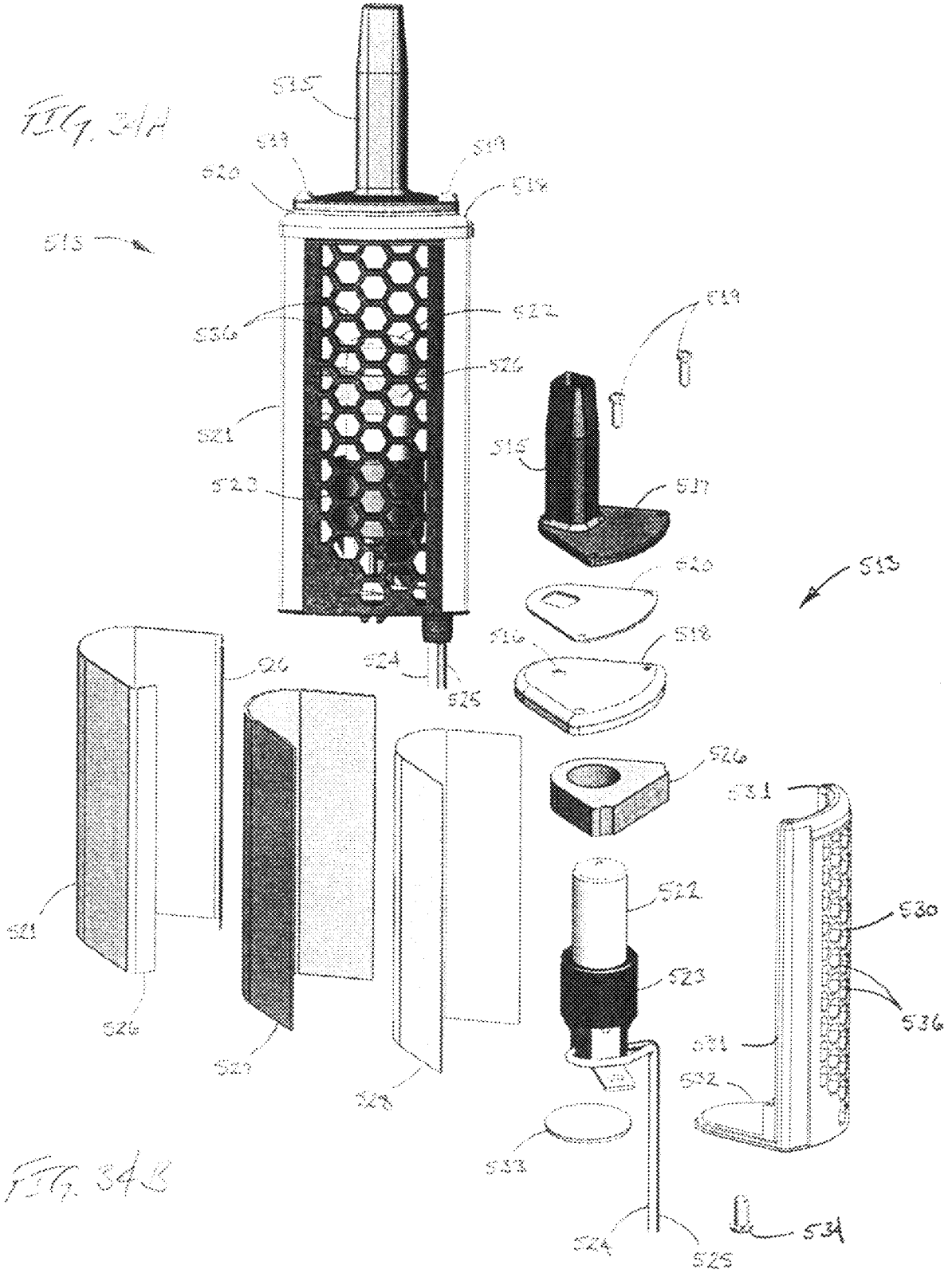
FIG. 34A is a front perspective view of an ion/ozone generator that is mounted in the bag housing as shown in FIGS. 27 and 29.
FIG. 34B is an exploded view of the ion/ozone generator of FIG. 34A showing the components and structure of the generator in greater detail.

A UV ozone/negative-ion generator 513 is mounted in the interior of the bag housing 56, in a cooperatingly shaped recess or nook 514 in shell 460. Bleed air from tube 432 (see FIG. 25) enters the ozone generator via an intake neck 515 having a metering orifice 516 at its base. As can be seen in FIGS. 34A and 34B, the intake neck 515 includes a base flange 517 that is mounted to a cap piece 518 of the generator by screws 519, with an anti-vibration/insulation pad 520 sandwiched between the two pieces. The cap piece includes the metering orifice 516 that communicates with the intake neck, and in turn is mounted to a vertically elongate housing 518, that in the illustrated embodiment has a somewhat triangular cross-section in the horizontal plane. The housing encloses a UV bulb 520 mounted in a socket 522 in the lower part of the housing, to which power is supplied via leads 524, 526. The upper end of the UV bulb is supported within an opening of a cushioning insert 528 set within the housing, to protect the bulb against vibration and thereby increase longevity.

As can be seen with further reference to FIG. 34B, body 421 forms a vertically-elongate shell that is somewhat triangular in cross-section, with two enclosed sides at the rear and an opening at the front, the latter being bordered by inwardly-extending flange portions 526. A thermal insulation pad 527 and overlying metal shield 528 are sandwiched against the rear inside surface of housing 521, a reflective surface of the shield being directed towards the open side of the housing. A discharge grill 530 is mounted over an open side of housing 521, where it receives exposure to UV radiation from bulb 522, with edges 531 of the grill being slidingly received in channels behind the flanges 526 along the edges of the open side of the housing for ease of removal and replacement. A lower flange 532 of the grill, to which the socket 522 is mounted over anti-vibration/insulation pad 533 by screw 534, forms a lower cover for housing 521. The front panel of the grill member is outwardly bowed, and includes a plurality of openings 536 through which the air passes, and also in which the material of the grill is exposed to the UV light, the grill openings preferably having a hexagonal, honeycomb configuration as shown in order to maximize the exposed surface area per volume of material.

The grill member 530 is formed of plastic or other material impregnated and/or coated with titanium dioxide or other material that emits negative ions and ozone in response to exposure to UV light, and as can be seen in FIGS. 27 and 29 is mounted to be in communication with the interior chamber 466 of the bag housing. Vacuum applied to the interior of the bag housing thus draws the bleed air downwardly through the metering tube 432 and neck 14 into the interior of housing 518, and from there outwardly through openings 538 carrying the negative ion and ozone that is produced by generator 510. As can be see in FIG. 22, the generator is mounted in housing 56 such that the outer surface of grill 530 lies substantially in the same plane as the edges of the ribs 470 on the associated side of chamber 466, so that the face of the grill in effect replaces the ribs in supporting the side of the collection bag in this area.

Negative ions and ozone produced by generator 513 are thus released into the primary airflow after the latter has been filtered by passing through the medium of the collection bag. The flow rate established by orifice 515 is selected relative to the power of the UV lamp and the ion/ozone generation capacity of grill 530 to produce an amount of ions sufficient to improve air quality without creating excessive concentrations of ozone in the exhaust airflow.

As can be seen with further reference to FIGS. 27 and 29, the side of bag housing 56 opposite ozone generator 513 includes a channel 540 that extends more-or-less coaxially with the upper end of tube 40 that receives hose 66 when handle 60 is placed in holder 62. Furthermore, to allow the option of switching the generator "on" and "off," a switch 551 is mounted in shell 446 and is accompanied by an indicator light 553 (e.g., an LED), with power being supplied to the indicator light via leads 546, 548 that pass through a grommet in a bottom panel 552 of the housing.

Figure 36:
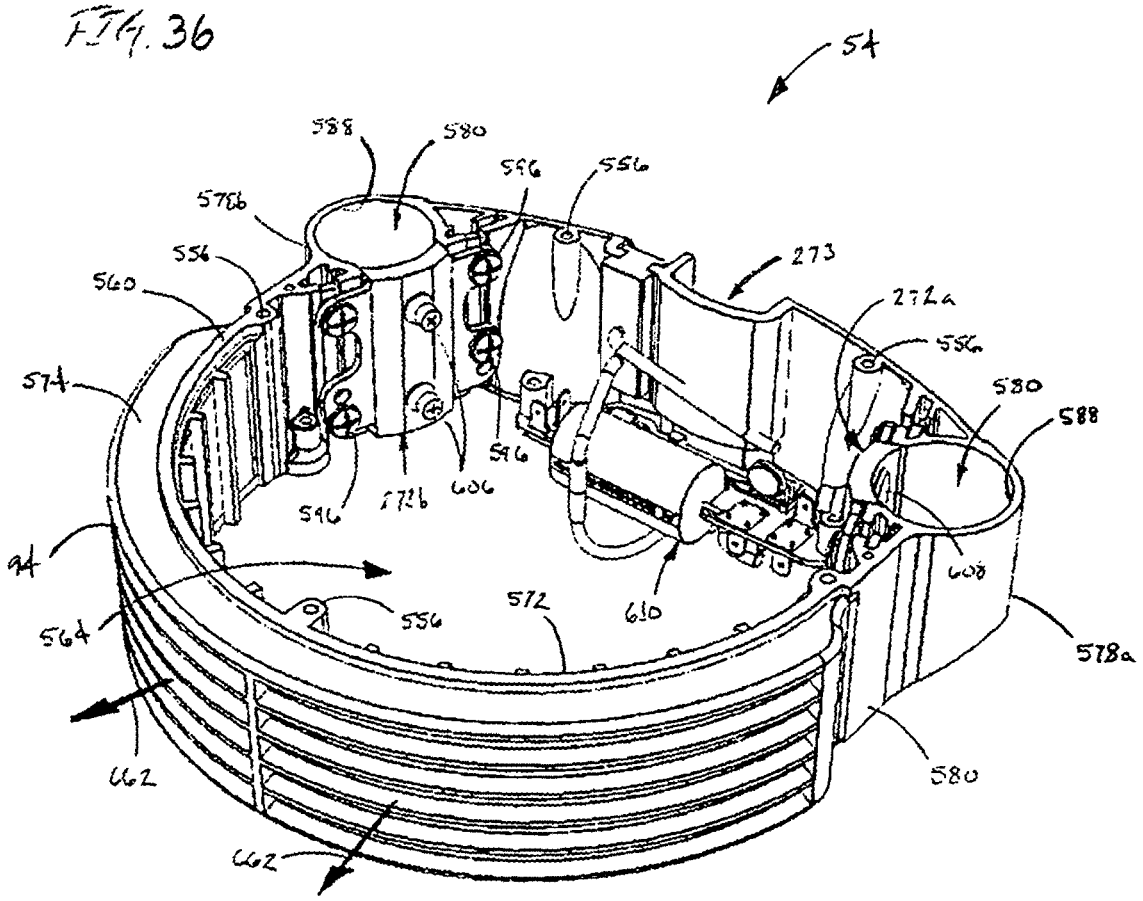
FIG. 36 is an upper front perspective view of the exhaust housing of the body assembly of FIGS. 22-23.

A plurality of screws 556 located about the base of the bag housing are received in bores above the upper end of the exhaust housing 54 so as to mate the lower edge 558 of the bag housing as shown in FIG. 35 with the upper edge 560 of the exhaust housing as shown in FIG. 36. A somewhat semicircular diverter wall 562 (see FIG. 39) extends upwardly from the underlying motor housing 52 through the open interior 564 of the exhaust housing, with resiliently, doughnut-shaped seal 566 at the upper edge of the diverter wall bearing against the bottom panel 552 of the bag housing around the discharge size of the pre-filter element 500 so as to form an air-tight seal around the flow path between the pre-filter and the intake 568 of the blower 570.

At the front the exhaust housing is an interior grill 572 through which the airflow passes after being discharged from the blower, as will be described below. An exhaust filter 574 overlies the interior grill 572 so that air exiting the grill passes therethrough, the exhaust filter element being retained and protected by the removable exterior grill 94, which also serves to deflect the exhausted air downward and way from the operator. The exhaust filter element provides an additional filtration stage for the airflow that has previously passed through the medium of the particulate collection bag and the pre-filter 500, and is suitably constructed of a foam or fiber filter medium that captures small particulates that may have escaped the first two stages. The exhaust filter element also acts as a muffler, further reducing noise that would otherwise be emitted with the exhaust flow.

Figure 37:
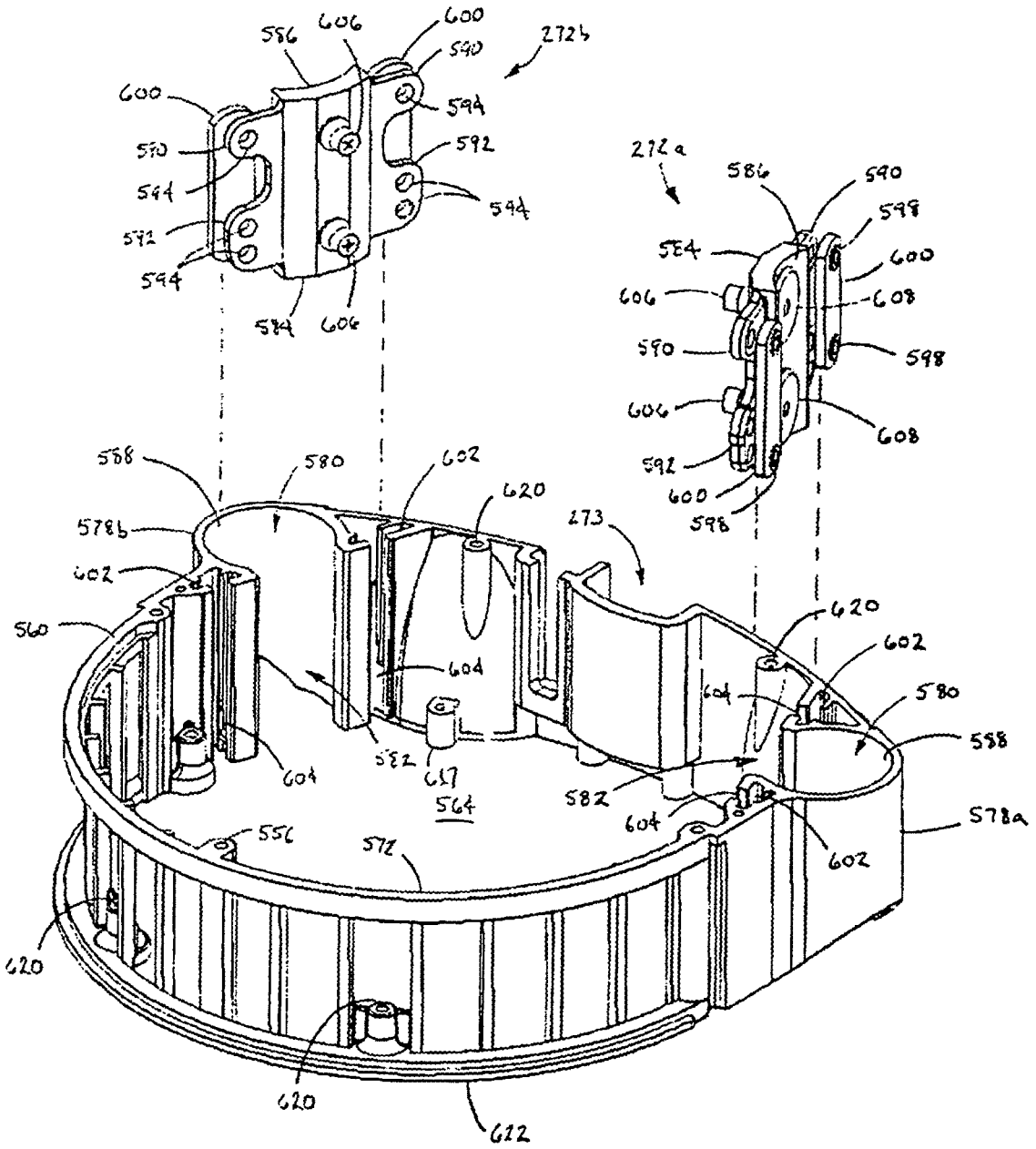
FIG. 37 is an upper front perspective view of the shell of the exhaust housing of FIG. 36, with the mounting clamps that engage the tubular lower frame assembly being shown separated therefrom.

Towards the rear, first and second tubular blisters 578*a*, 578*b* are formed on opposite sides of the main shell 580 of the exhaust housing, each of which includes a generally vertically extending cylindrical bore 580 that is sized and aligned to receive one of the upper ends of the tubes forming the Y-shaped lower frame assembly, i.e., the bore 580 in blister 578*a* is configured to receive the upper end 206 of tubular member 40, and the bore of blister 578*b* is configured to receive the upper end 208 of the second tubular member 42. As can be seen in FIG. 37, longitudinally extending cutouts 582 are formed along the inner sides of the bores 580, adjoining the central opening 564 of the exhaust housing, in which the tube clamp assemblies 276*a*, 276*b* are installed. Each of the identical clamp assemblies includes a somewhat rectangular shaped body 584 having a clamping surface 586 disposed inwardly towards the bore 580, the clamping surface having a concave curvature that corresponds to that of the inside surface 588 of the bore so as to form a substantially continuous cylindrical surface about the exterior of the tube end that is received in the bore. Upper and lower flanges 590, 592 extend outwardly along the two longitudinal edges of the outer side of clamp body 584, and include bores 594 through which the ends of machine screws 596 pass and are threaded into cooperating bores 598 in vertically elongate nut plates that lie behind the upper and lower flanges on both sides of the clamp body. The longitudinal edges of the plates 600 are received in cooperating channels 602 formed in the housing adjacent the cutouts 582, the shafts of the machine screws being accommodated in slots 604 so as to allow the assembled clamps 276*a*, 276*b* to be slid vertically into place. The front-to-back spacing between the nut plates 600 and edge flanges of the clamp body is selected relative to the clamp face 586 such that in response to tightening of the machine screws the clamp face 586 is forced against the end of the tube that is received in the associated bore 580. The nut plates and clamp bodies are suitably formed of steel or other metallic material. Mushroom-shaped resilient plugs 606, suitably formed of synthetic rubber or similar material, are installed through clamp bodies 584, with the enlarged-diameter ends 608 of the plugs facing towards bores 580 so as to aid in establishing a frictional engagement with the tubes as the clamp assemblies are tightened. The clamp assemblies, in cooperation with the inner surfaces of the cylindrical bores 580, thus form a firm, stable, load-transmitting engagement between the exhaust housing 54 and the upper ends of the tubular members on both sides of the Y-shaped lower frame assembly 30.

Figure 38:
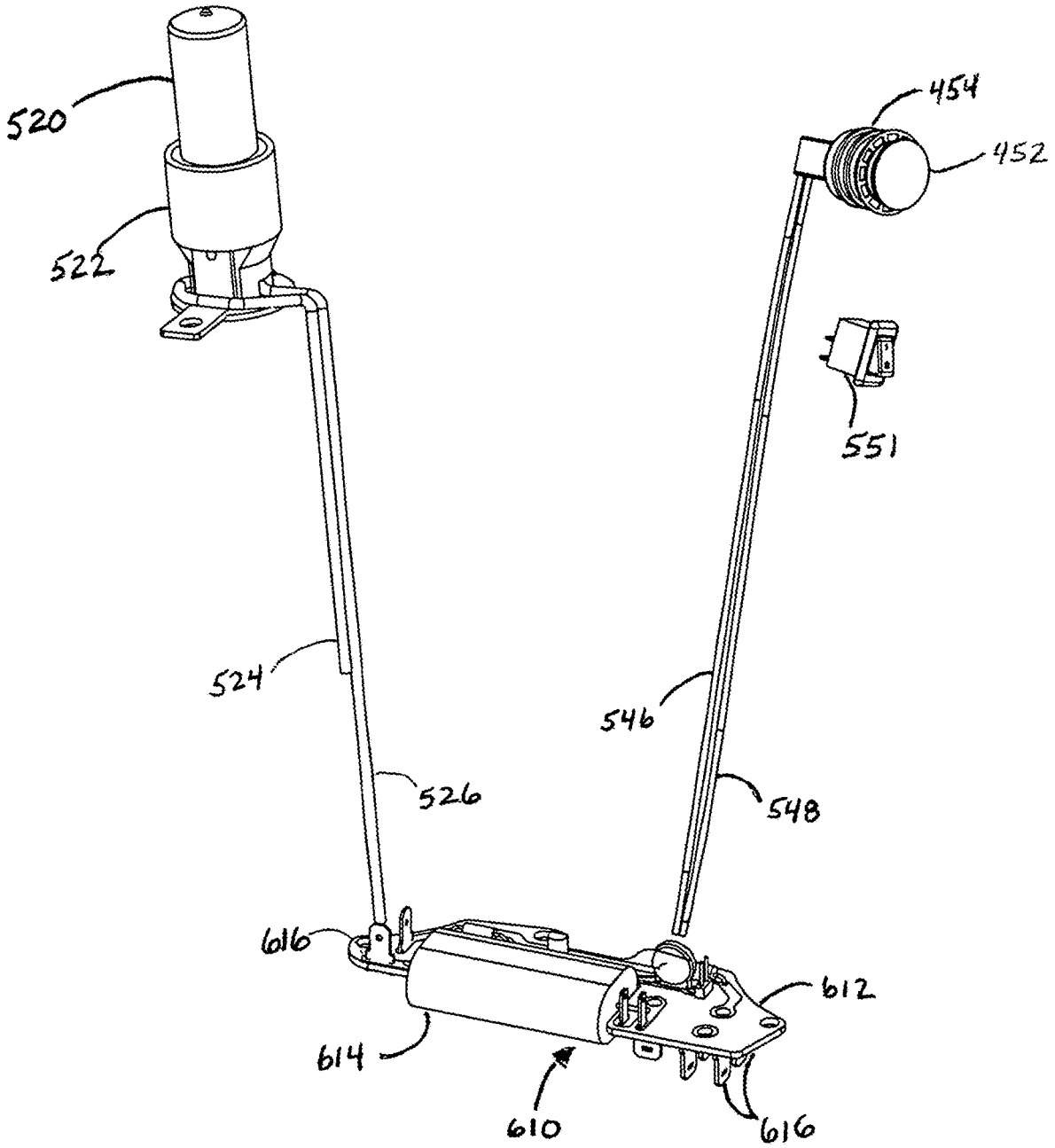
FIG. 38 is a perspective view of a circuit module that provides power from within the exhaust housing of FIG. 36 to the bulb of the ozone generator of FIGS. 34A-34B and to a switch and an LED on-indicator that are also mounted in the bag housing.

Exhaust housing 54 also accommodates a circuit module 610, mounted proximate the back of shell 560. As can be seen in FIG. 38, the circuit module includes a board 612, capacitor 614, spade connections 616, and other components, configured as known to those skilled in the relevant art to condition and supply electrical power to various components of the machine, including as the rocker switch 551, the UV lamp 520 of generator 510, and the "on" indicator LED 553. The circuit module is positioned at the rear of the central opening 564 of the exhaust housing on bosses 617, in order to provide clearance for the upper end of the blower and the doughnut-shaped seal 566 where these extend upwardly to mate against the bottom panel of the bag housing.

Figure 39:
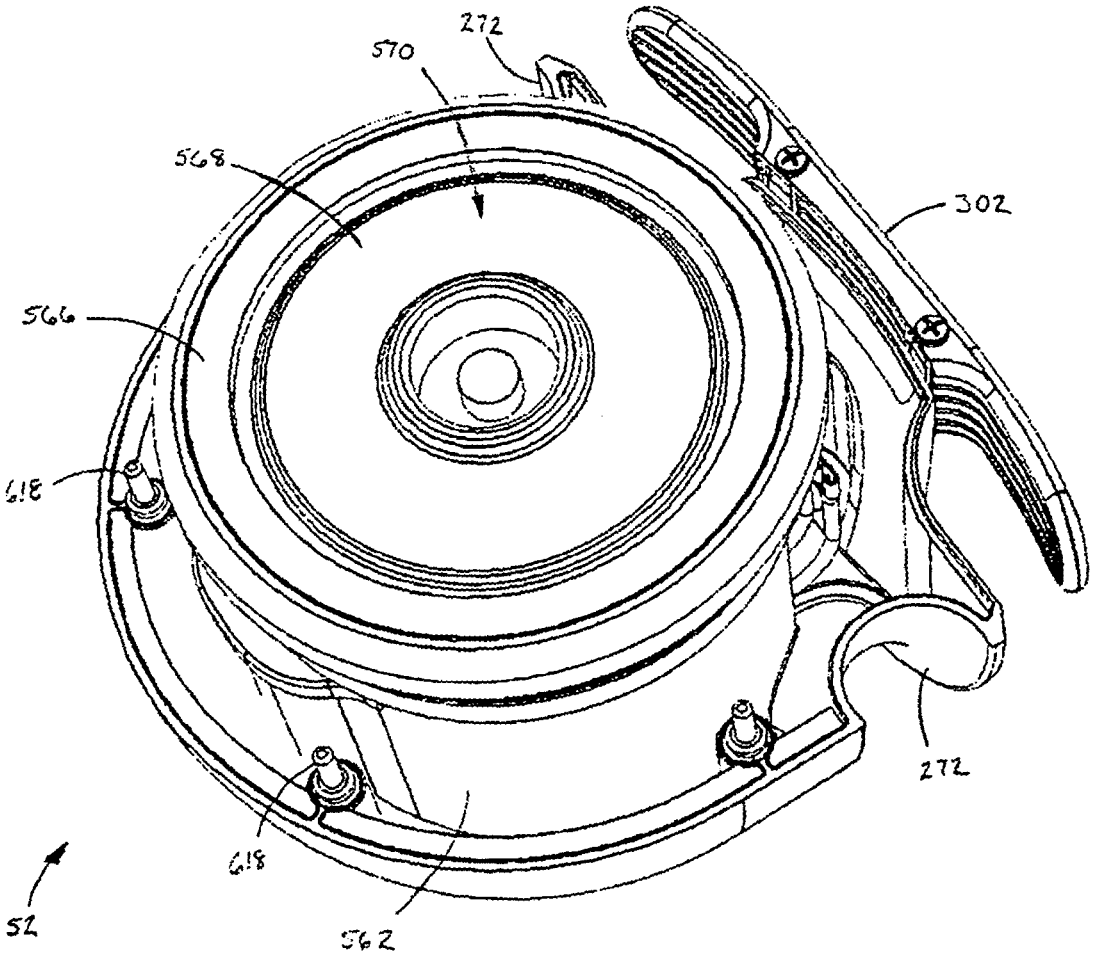
FIG. 39 is an upper front perspective view of the lower motor housing of the body assembly of FIGS. 22-23, showing the vacuum blower of the body assembly mounted therein.

The motor housing 52 is mounted to the lower end of the bag housing by screws 618 that extend from the motor housing into cooperating bores 620 around the lower edge 622 of the shell of the exhaust housing. As described above, doughnut-shaped seal 566 establishes an airtight seal around the mouth 568 of blower 570 and the pre-filter assembly 500 at the bottom of bag housing 56, so that operation of the blower draws a flow of air through the pre-filter element and applies vacuum to the chamber 466 of the bag housing. As can be seen in FIG. 39, a base plate 630 of the blower motor is supported on a pedestal 634 that extends upwardly from the bowl-shaped lower interior of the shell 636 of the motor housing, and is strengthened by gusset walls 638. Power is supplied to the blower motor via leads 640, 642.

The blower in the illustrated embodiment has a conventional radial-discharge configuration, such that air drawn in through the intake opening 646 at the top is discharged in a radial direction. The discharge side of the blower is semi-enclosed within the semi-cylindrical internal diverter wall 562 of the motor housing, such that the air discharged radially from the blower impinges the inside surface 644 of the diverter wall and is directed towards the opening 568 at the rearward side thereof. Exhaust noise is therefore contained by wall 562 over most of the perimeter of the blower, and that which escapes with the airflow is directed initially against the closed back wall 648 of shell 636, in a direction opposite the vents at the front of exhaust housing. The airflow is redirected by the back wall of the shell outwardly around the edges 650 of the diverter wall, as indicated by arrows 652 in FIG. 40. The airflow then moves forwardly through the annular space between the diverter wall 562 and the outer wall 654 of the shell of the housing, as indicated by arrows 656, the inside surface of the latter being lined by a layer of sound-absorbing material 658 to further reduce noise emissions. The annular space is partially constricted by a protrusion 660 at the front of diverter wall 562, with the airflow moving along the sides of the containment wall and then upwardly and forwardly to exit through vent 576 in a direction away from the operator, as indicated by arrows 662 in FIG. 36, the final filter 574 providing an additional sound deadening effect. Thus, by the combination of the manner in which the exhaust flow is routed and use of the sound deadening materials in strategic areas, noise perceived by the operator is greatly reduced.

Figure 41:
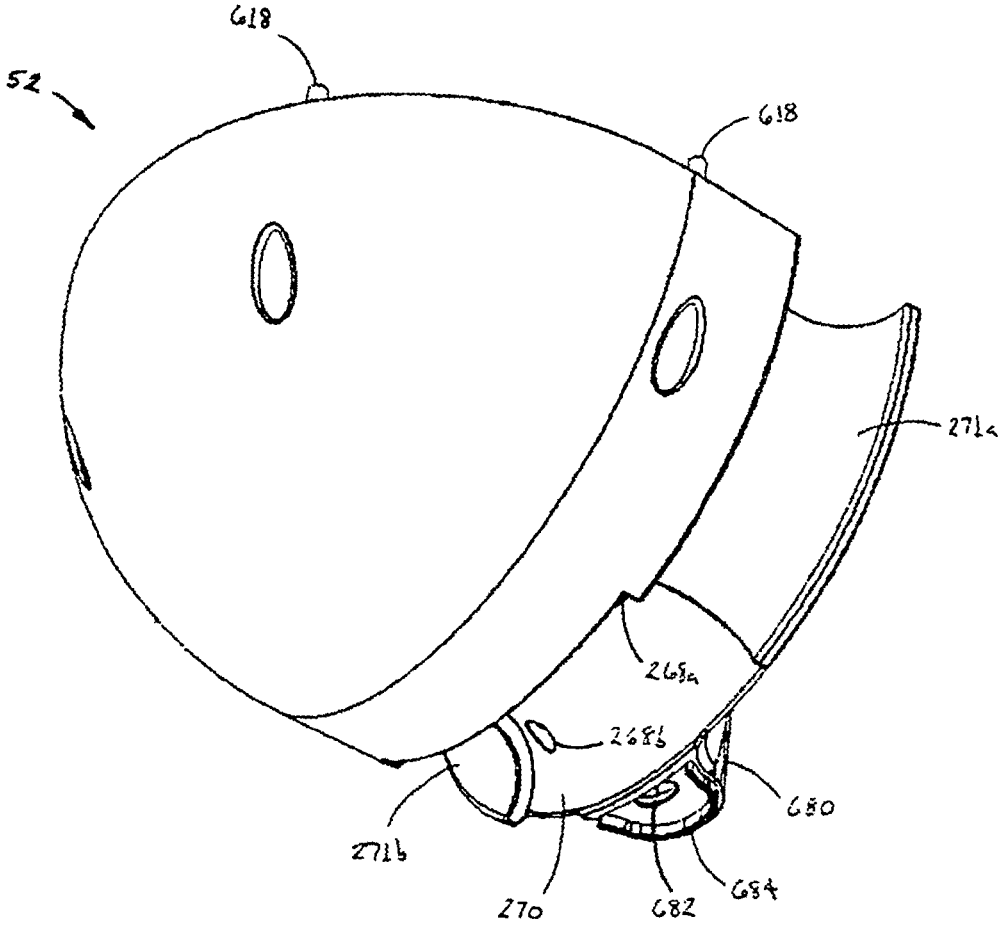
FIG. 41 is a lower front perspective view of the motor housing of FIGS. 39-40, showing concave channel areas formed in the shell thereof that receive the tubular legs of the Y-shaped lower frame assembly so as to transfer loads to the frame assembly from the body assembly of the machine.

As can be seen in FIG. 41, the rear of the motor housing 52 also includes a cover 680 for the leads supplying power to the nozzle assembly. The leads exit the cover via an opening 682 at the lower end thereof, the opening being bordered to the rear by depending skirt 684 that is received in a cooperating opening (not shown) in the upper end of the cover 254 on the back of the Y-shaped frame clamp assembly, so as to form a clean, tight fitting connection therewith in which the leads are completely shrouded.

As noted above, and as can be seen in FIG. 42A, the cord wrap 302 (the lower cord bracket) mounts to the rear of the body assembly, at the junction between the motor and exhaust housings 42, 54. Corresponding sets of bosses 672 with vertical bores protrude from the rearward sides of the housings and meet in vertical pairs at the joint between the housings. Each of the pairs of bosses is in turn received in a cooperating, tightly-fitting recess 673 in the forward side of the cord wrap, and screws 670 are threaded through the bores in the bosses and coaxially aligned bores at the ends of the recesses 673 so as to clamp the housings together at their rearward sides.

Figure 40:
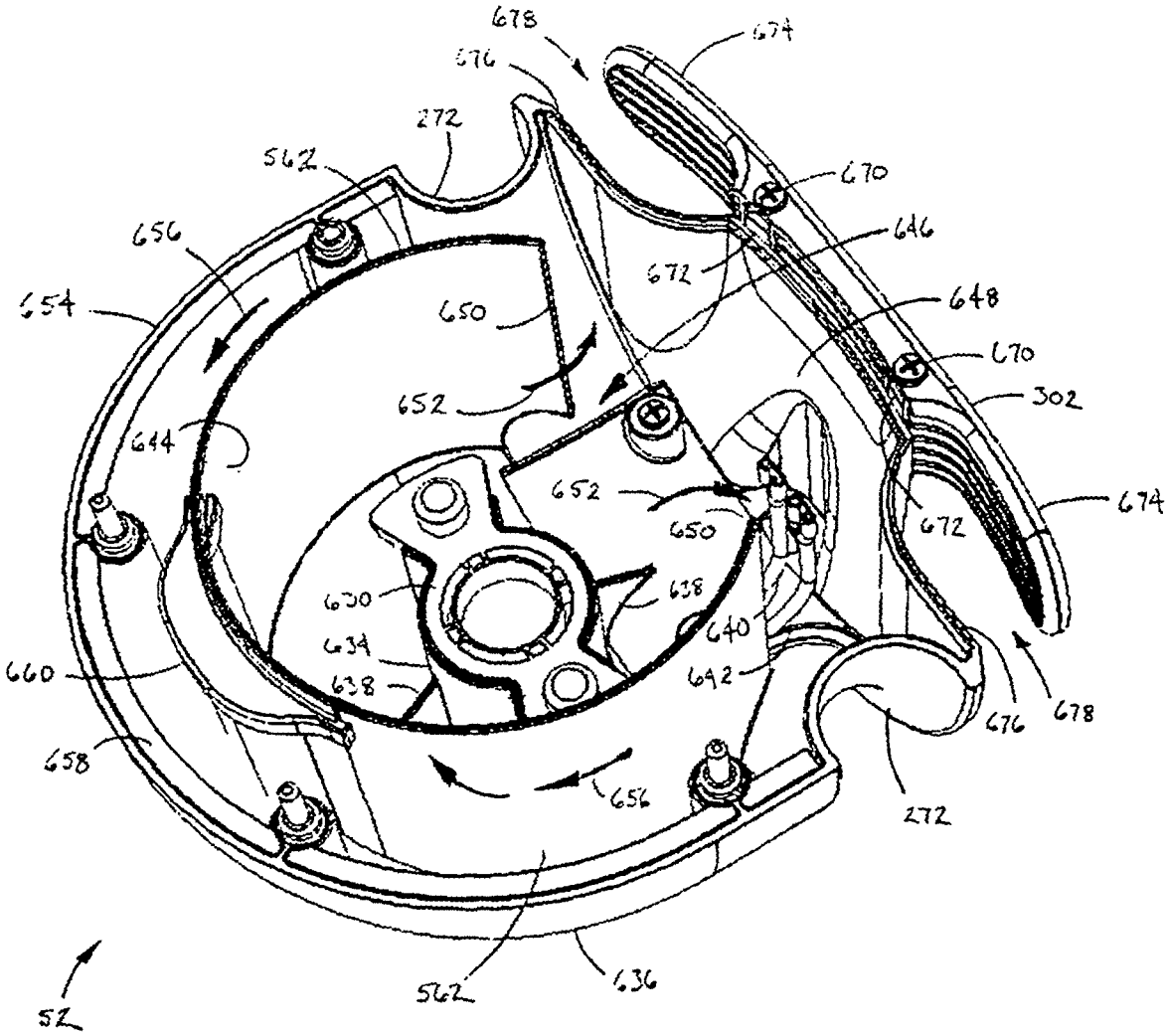
FIG. 40 is a second upper front perspective view of the motor housing of FIG. 39, with the vacuum blower removed to show the internal structure and components of the housing in greater detail.

As can be seen in FIG. 40, somewhat forwardly curved wing portions 674 of the wrap extend outwardly at a spaced distance from juxtaposed, concavely curved surfaces 676 on the rearward sides of shell 636, to define jaw areas 678 that receive the cord when wrapped around bracket 302 and over cord dump 292 as described above, the surfaces converging somewhat distally to hold the cord neatly and securely in place.

It is to be recognized that various alterations, modifications, and/or additions may be introduced into the constructions and arrangements of parts described above without departing from the spirit or ambit of the present invention.

What is claimed is:

1. A vacuum cleaner, comprising:

a nozzle assembly;

an upright body assembly; and a frame assembly that supports the body assembly on the nozzle assembly, the frame assembly comprising:

first and second elongate frame members having spaced apart upper end portions that extend along first and second lateral sides of said body assembly and lower end portions that converge at a junction generally beneath said body assembly; and a central frame member that extends generally downwardly from said junction so as to support said body assembly on said nozzle assembly said downwardly-extending central frame member comprising:

a bore that is in communication with a bore in said first elongate frame member so as to establish a path for a flow of air from said nozzle assembly to said body assembly, wherein said downwardly-extending central frame member and said first elongate frame member define a continuous passage.

2. The vacuum cleaner of claim 1, wherein said downwardly-extending central frame member and said first elongate frame member are formed of a substantially continuous tubular member.

3. The vacuum cleaner of claim 2, wherein said second elongate frame member comprises:

a second tubular member.

4. The vacuum cleaner of claim 3, further comprising:

a clamp assembly that joins said first and second tubular member at said junction beneath said body assembly.

5. The vacuum cleaner of claim 1, wherein said upper end portions of said first and second elongate frame members are substantially equidistantly spaced on opposite sides of a front-to-back centerline plane of said vacuum cleaner, and wherein said downwardly-extending central frame member is substantially centered on said front-to-back centerline plane of said vacuum cleaner.

6. The vacuum cleaner of claim 5, wherein said upwardly extending ends of said first and second elongate frame members are mounted to opposite sides of said body assembly so as to balance loads transmitted thereby from said body assembly to said downwardly-extending central frame member.

7. The vacuum cleaner of claim 6, wherein said junction between said first and second elongate frame members forms a saddle that supports at least a portion of a weight of said body assembly.

8. The vacuum cleaner of claim 5, wherein said body assembly comprises:

at least one handle member that enables an operator to apply front-to-back and rotational motions to said body assembly, said handle member being substantially centered on said front-to-back centerline plane of said vacuum cleaner.

9. The vacuum cleaner of claim 8, further comprising:

an articulated elbow assembly that interconnects said downwardly-extending central frame member and said nozzle assembly so as to transmit to said nozzle assembly said front-to-back and rotational motions that are applied to said body assembly by an operator.

10. The vacuum cleaner of claim 9, wherein said elbow assembly comprises:

an internal passage substantially continuous with said passage of said downwardly-extending central frame member and said first elongate frame member, that form said flow path from said nozzle assembly to said body assembly.

11. The vacuum cleaner of claim 10, wherein said articulated elbow assembly comprises:

upper and lower segments joined at a pivot connection.

12. The vacuum cleaner of claim 11, wherein said upper segment of said articulated elbow assembly comprises:

a tubular sleeve portion that receives a lower end of said downwardly-extending central member of said frame assembly that is mounted to said body assembly.

13. The vacuum cleaner of claim 11, wherein said lower segment of said elbow assembly comprises:

a generally barrel-shaped body having an opening on a distal side thereof that communicates with an internal chamber of said nozzle assembly so as to establish a flow path therewith; and a generally cylindrical outer surface that forms a sliding seal against cooperating surfaces of said nozzle assembly on sides of said opening in said nozzle assembly.

14. The vacuum cleaner of claim 13, wherein said barrel-shaped body of said lower segment of said elbow assembly further comprises:

first and second axle portions that extend axially from opposite ends of said body and that cooperate with axle openings in the nozzle assembly to establish a horizontal axis pivot connection between said nozzle assembly and said lower segment of said elbow assembly.

15. The vacuum cleaner of claim 9, further comprising:

an upper frame assembly mounted to said body assembly and having an upper end to which said at least one handle member is mounted.

16. The vacuum cleaner of claim 15, wherein said upper frame assembly comprises an elongate bar member that is mounted to a rearward side of said body assembly substantially in said front-to-back centerline plane of said vacuum cleaner.

17. The vacuum cleaner of claim 1, wherein said body of said vacuum cleaner comprises:

a vacuum blower that generates said flow of air that is received by said body assembly from said nozzle assembly of said vacuum cleaner; and an ozone generator that introduces a supply of ozone and ions into said flow of air.

18. The vacuum cleaner of claim 17, wherein said body assembly of said vacuum cleaner further comprises:

a bag housing that contains a filter bag that collects particulate material from said flow of air, said ozone generator being located to introduce said ozone and ions into said flow of air after said flow of air passes through said filter bag.

19. The vacuum cleaner of claim 18, wherein said bag housing further comprises:

a plurality of inwardly-extending ribs that support a medium of said filter bag while leaving channels intermediate said ribs for a flow of air exiting said bag.

20. The vacuum cleaner of claim 19, wherein said ozone generator is mounted in said bag housing in communication with at least one of said channels intermediate said ribs so as to introduce said ozone and ions into said flow of air exiting said filter bag.

* * * * *